US006252573B1

(12) United States Patent
Ito et al.

(10) Patent No.: US 6,252,573 B1
(45) **Date of Patent: *Jun. 26, 2001**

(54) DRIVE METHOD, A DRIVE CIRCUIT AND A DISPLAY DEVICE FOR LIQUID CRYSTAL CELLS

(75) Inventors: Akihiko Ito; Shoichi Iino, both of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/281,997

(22) Filed: Mar. 29, 1999

Related U.S. Application Data

(63) Continuation of application No. 08/148,083, filed on Nov. 4, 1993, now Pat. No. 6,084,563, which is a continuation-in-part of application No. PCT/JP93/00279, filed on Mar. 4, 1993.

(30) Foreign Application Priority Data

Mar. 5, 1992 (JP) ..... 4-48743
Apr. 6, 1992 (JP) ..... 4-84007
May 8, 1992 (JP) ..... 4-143482

(51) Int. Cl.[7] ..... G09G 3/36

(52) U.S. Cl. ..... 345/100
(58) Field of Search ..... 345/89, 98–100

(56) References Cited

U.S. PATENT DOCUMENTS

| | | |
|---|---|---|
| 3,973,252 | 8/1976 | Mitomo . |
| 4,100,579 | 7/1978 | Ernstoff . |
| 4,683,497 | 7/1987 | Mehrgardt . |
| 4,873,516 | 10/1989 | Castleberry . |
| 5,262,881 | 11/1993 | Kuwata . |
| 5,280,280 | 1/1994 | Hotto . |
| 5,420,604 | 5/1995 | Scheffer . |

FOREIGN PATENT DOCUMENTS

| | | |
|---|---|---|
| 645473 | 9/1984 | (CH) . |
| 4031905 | 4/1991 | (DE) . |
| 0569974 | 11/1983 | (EP) . |
| 0349415 | 1/1990 | (EP) . |
| 0388976 | 9/1990 | (EP) . |
| 0479450 | 4/1992 | (EP) . |
| 0507061 | 10/1992 | (EP) . |
| 54-22856 | 8/1979 | (JP) . |
| 57-15393 | 3/1982 | (JP) . |
| 61-262724 | 11/1986 | (JP) . |
| 62-102230 | 5/1987 | (JP) . |
| 267694 | 10/1989 | (JP) . |
| 3-185490 | 8/1991 | (JP) . |
| 20550 | 10/1993 | (WO) . |
| 95 01628 | 1/1995 | (WO) . |

OTHER PUBLICATIONS

2449 Displays vol. 14 (1993) No. 2, Jordan Hill, Oxford, GB, "Active Addressing™ of STN displays for high–performance video applications" by T.J. Scheffer, B. Clifton, D. Prince and A.R. Conner, pp. 74–85.

2320 Proceedings of the S.I.D. vol. 24 (1983) No. 3, Los Angeles, CA USA "New Addressing Techniques for Multiplexed Liquid Crystal Displays" by T.N. Ruckmongathan and N.V. Madhusudana, pp. 259–262.

(List continued on next page.)

*Primary Examiner*—Jeffery Brier

(57) ABSTRACT

A multiplex driving method is provided for a liquid crystal cell device having a liquid crystal layer disposed between a pair of substrates, a plurality of row electrodes arranged on one of the substrates and a plurality of column electrodes arranged on the other substrate. The method comprises the steps of sequentially selecting a group of the plurality of row electrodes during a selection period, simultaneously selecting the row electrodes comprising the group, and dividing and separating the selection period into a plurality of intervals within one frame period.

33 Claims, 21 Drawing Sheets

OTHER PUBLICATIONS

1992 SID International Symposium, May 1992, "Active Addressing Method For High–Contrast Video–Rate S TN Displays," T.J. Scheffer, B. Clifton, pp. 228–231.

Ruckmongathan, T.N. "A Generalized Addressing Technique For RMS Responding Matrix LCDs" 1988 IDR Conference pp. 80–85.

Proceedings Japan Display '92, Hiroshima, Japan; B. Clifton, D. Price, In Focus Systems, Inc., Tualatin, OR, USA "Hardware Architectures for Video–Rate, Active Addressed STN Displays" pp. 503–506.

1994 SID International Symposium, 7.2: *An Addressing Technique with R educed Hardware Complexity* by T.N. Ruckmongathan pp. 65–68.

1994 SID International Symposium, 7.1: A 9.4–in. *Color VGA F–STN Display with Fast Response Time and High Contrast Ratio by Using MLS Method*, by H. Muraji, H. Koh, T. Kuwata, Y. Nakagawa pp. 61–64.

1994 SID International Symposium, 7.3: *A Study of the Active Drive Method for oSTN–LCDs* by Y. Fukui, M. Yumine, T. Matsumoto, pp. 69–72.

"Some new Addressing Techniques for RMS Responding Matrix LCDs", Doctoral Thesis by Ruckmongathan, T.N., Feb. 1988.

Scheffer, et al. *"Pulse–Height Modulation (PHM) Gray Shading For Passive Matrix LCDs"*, Japan Display 92, pp. 69–72

Information and System Series From The Theory Of Matrix Construction To The Walsh Function *"The Hadamard Matrix And Its Application"*.

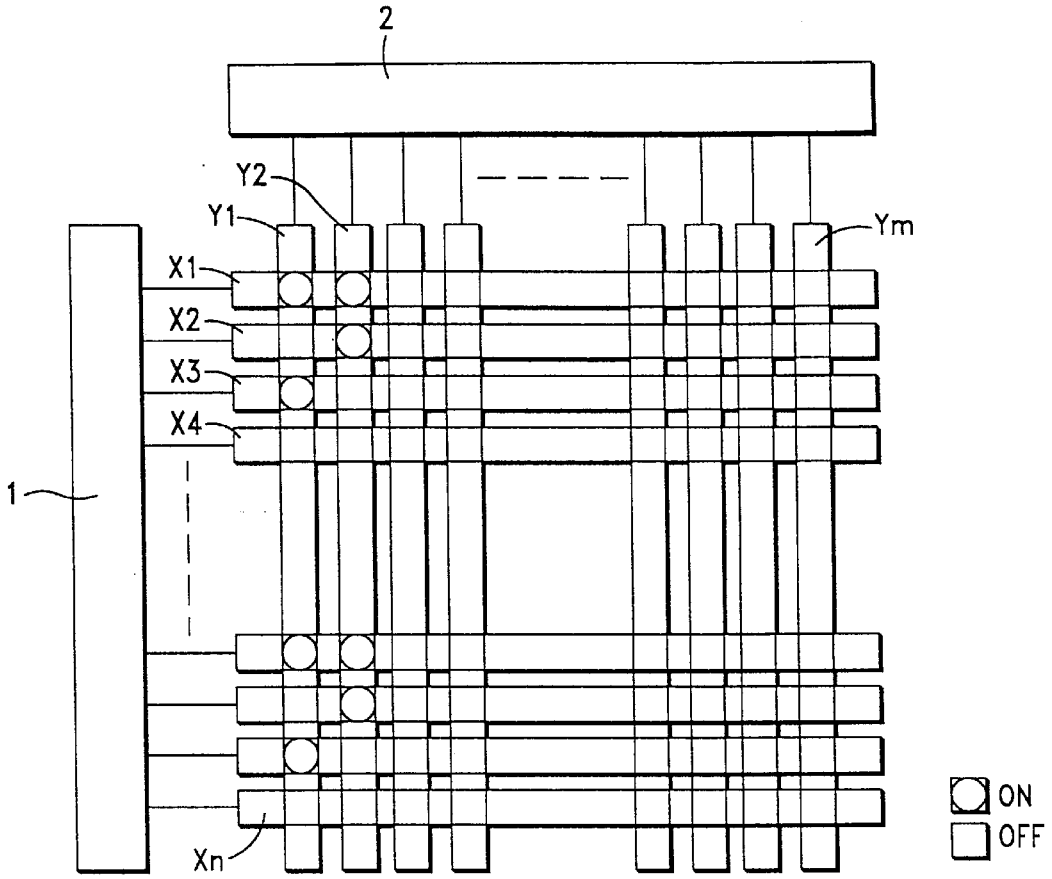
FIG.-2
FIG.-3
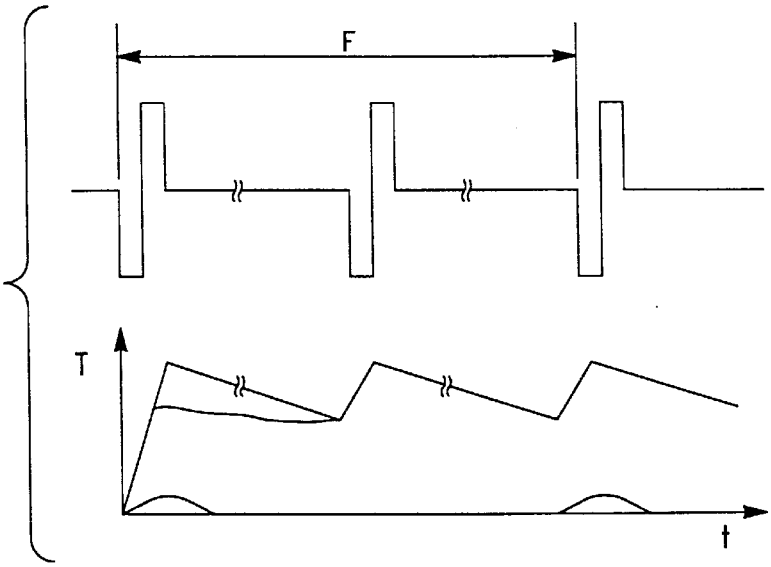

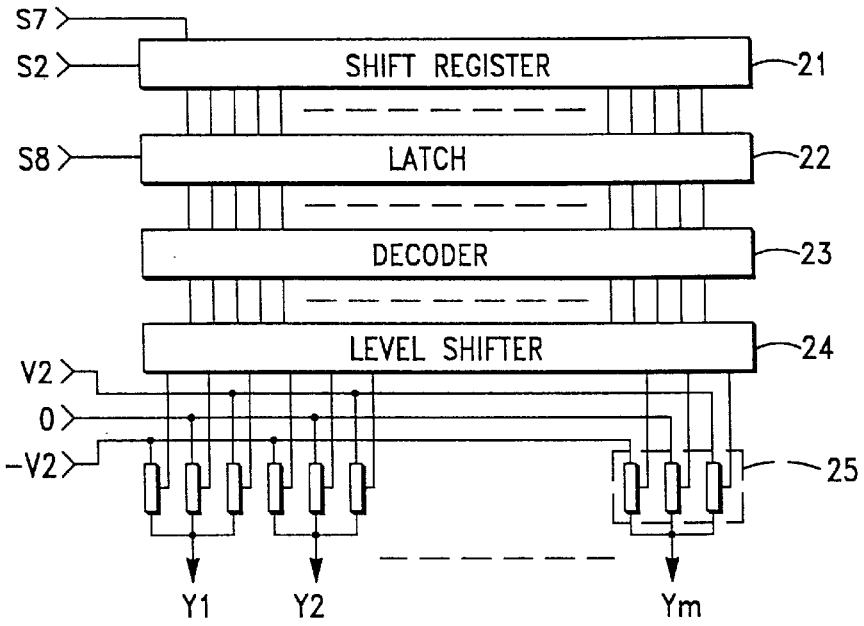
FIG.-6
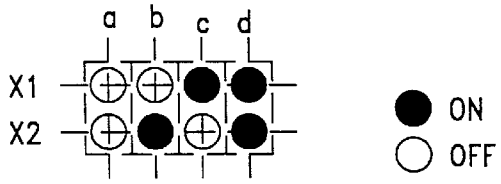
FIG.-9
FIG.-10A
FIG.-10B
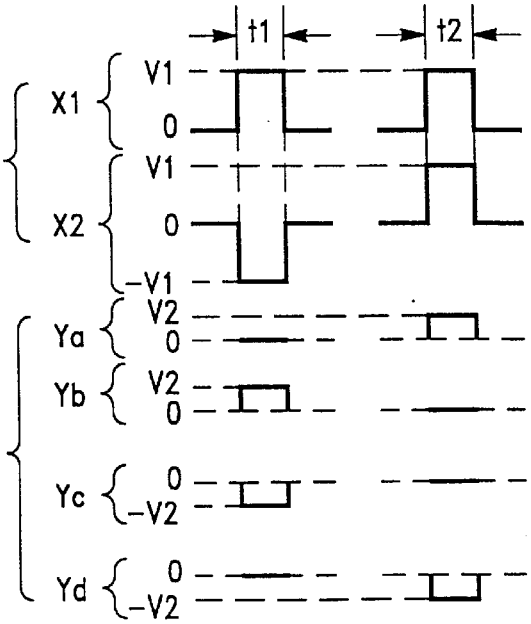

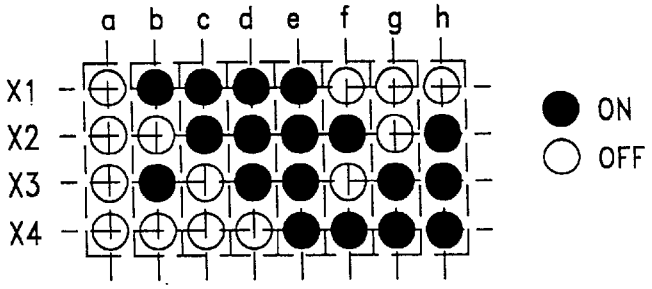
FIG.-12
FIG.-13A
FIG.-13B
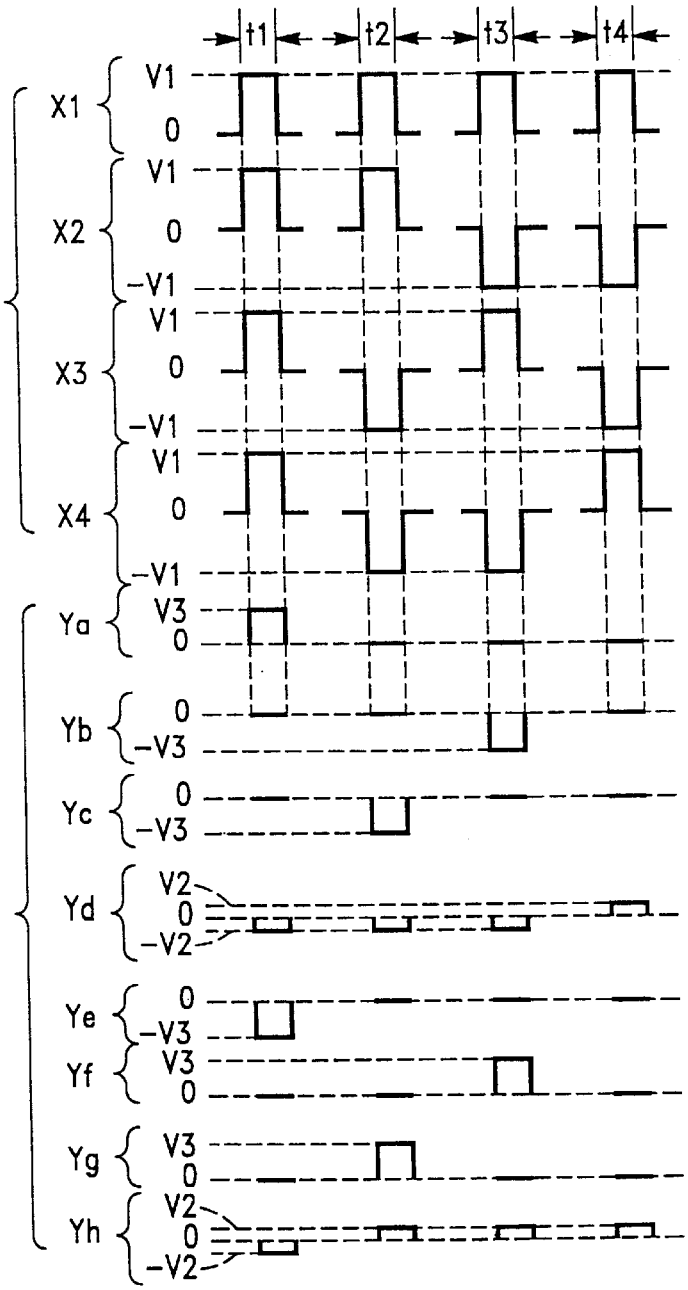

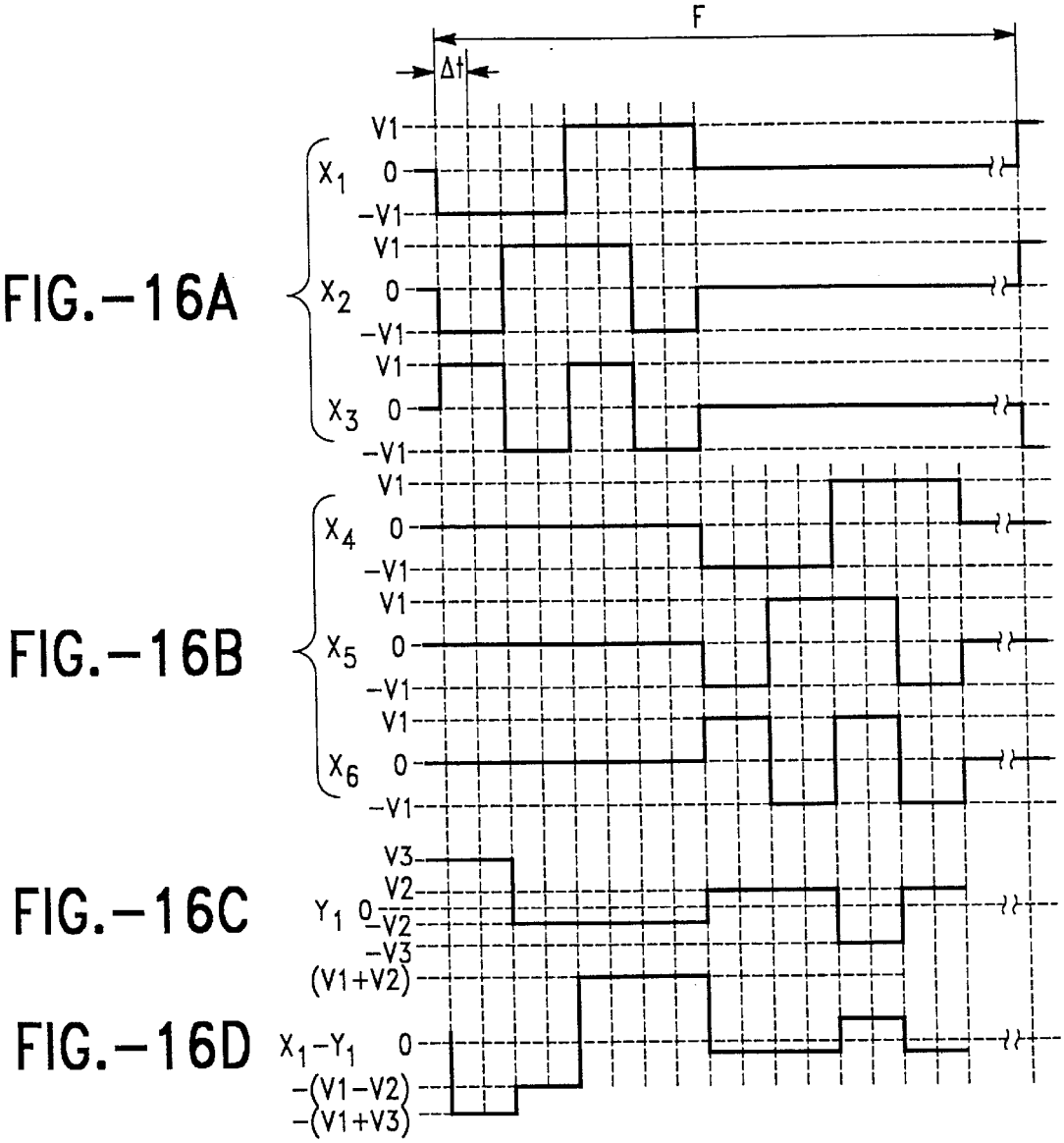
F
Δt
V1
0
−V1
X1
X2
X3
X4
X5
X6
V3
V2
−V2
−V3
Y1
(V1+V2)
X1−Y1
−(V1−V2)
−(V1+V3)
FIG.−16A
FIG.−16B
FIG.−16C
FIG.−16D

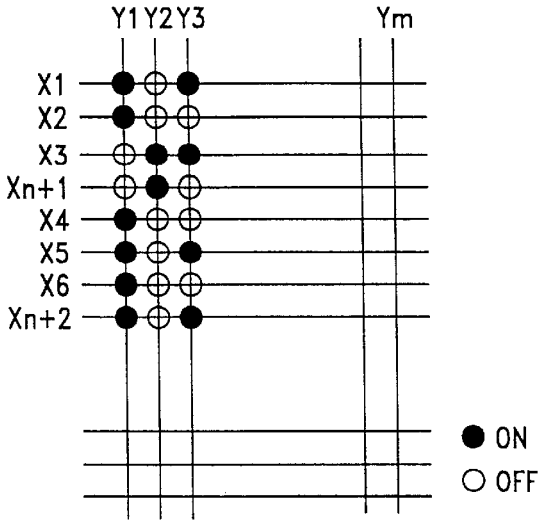
FIG.-20
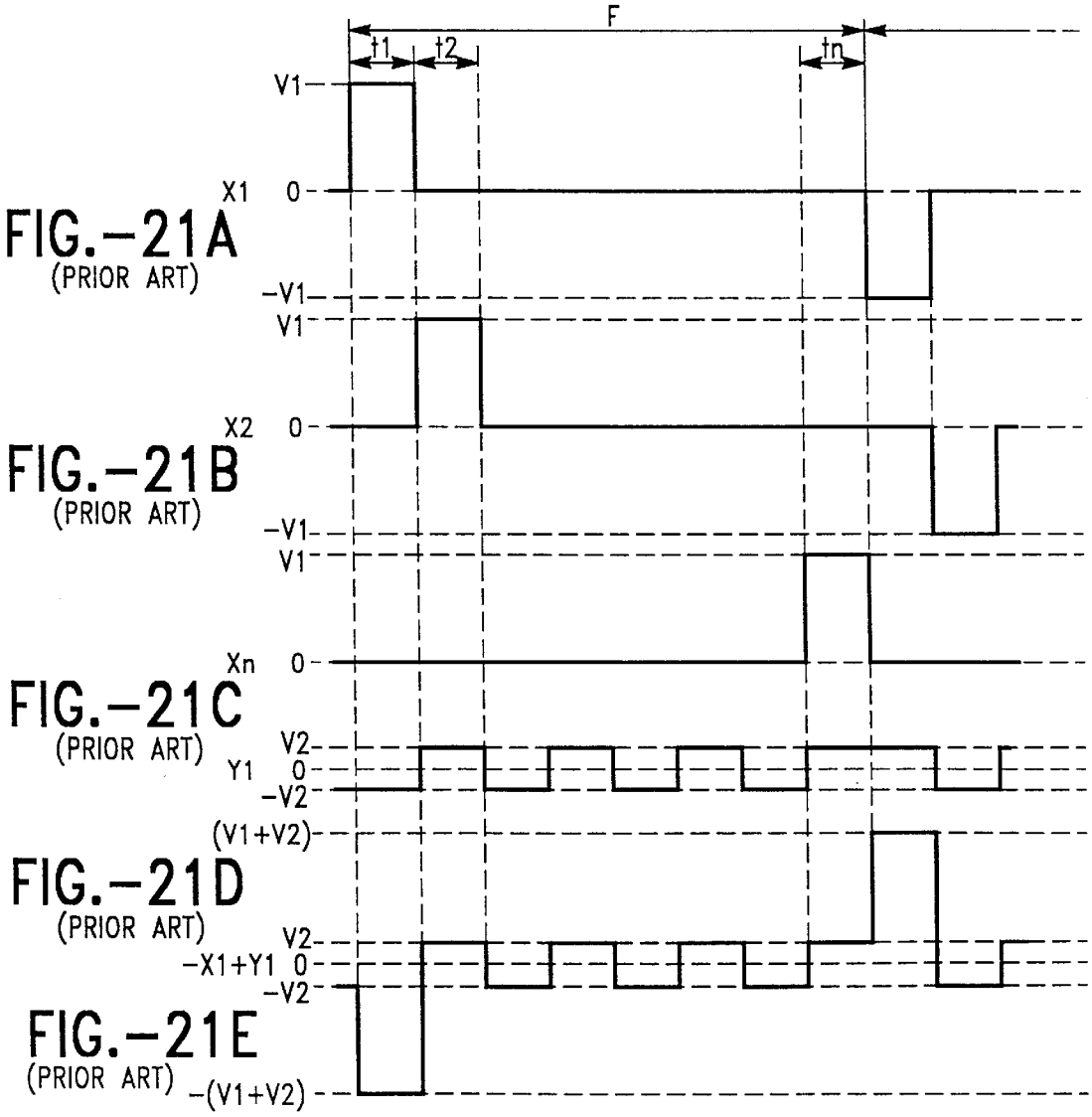
FIG.-21A (PRIOR ART)
FIG.-21B (PRIOR ART)
FIG.-21C (PRIOR ART)
FIG.-21D (PRIOR ART)
FIG.-21E (PRIOR ART)

DRIVE METHOD, A DRIVE CIRCUIT AND A DISPLAY DEVICE FOR LIQUID CRYSTAL CELLS

CONTINUING APPLICATION DATA

This application is a continuation of application Ser. No. 08/148,083 filed Nov. 4, 1993, U.S. Pat. No. 6,084,563, which is a continuation-in-part of International Application No. PCT/JP93/00279, filed on Mar. 4, 1993 designating the United States, the contents of each of which are incorporated herein by reference.

FIELD OF THE INVENTION

The present invention generally relates to a driving apparatus and a driving method for a liquid crystal display having a plurality of row electrodes and column electrodes. More particularly, the invention relates to such an apparatus and a method in which the row electrodes are divided into groups, each group being sequentially selected and the row electrodes within each group being simultaneously selected.

BACKGROUND OF THE INVENTION

Matrix liquid crystal displays such as, twisted nematic (TN) and super twisted nematic (STN), are known in the art. Reference is made to FIGS. 21(*a*)–(*e*) and 22 in which a conventional matrix liquid crystal display is provided. A liquid crystal panel generally indicated as 1 is composed of a liquid crystal layer 5, a first substrate 2 and a second substrate 3 for sandwiching the liquid crystal layer 5 therebetween. A group of column electrodes $Y_1$–$Y_m$ are oriented on substrate 2 in the vertical direction and a plurality of row electrodes $X_1$–$X_n$ are formed on substrate 3 in substantially the horizontal direction to form a matrix. Each intersection of column electrodes $Y_1$–$Y_m$ and row electrodes $X_1$–$X_n$ forms a display element or pixel 7. Display pixels 7 having the open circle indicate an ON state and those pixels having a blank indicate an OFF state.

A conventional multiplex driving based on the amplitude selective addressing scheme is known to one of ordinary skill in the art as one method of driving the liquid crystal cells mentioned above. In such a method, a selected voltage or non-selected voltage is sequentially applied to each of row electrodes $X_1$–$X_n$ individually. That is, a selection voltage is applied to only one row electrode at a time. In the conventional driving method, the time period required to apply the successive selected or non-selected voltage to all the row electrodes $X_1$–$X_n$ is known as one frame period, indicated in FIGS. 21(*a*)–(*e*) as time period F. Typically the frame period is approximate 1/60th of a second or 16.66 milliseconds.

Simultaneously to the successive application of the selected voltage or the non-selected voltage to each of the row electrodes $X_1$–$X_n$, a data signal representing an ON or OFF voltage is applied to column electrodes $Y_1$–$Y_m$. Accordingly, to turn a pixel 7 e.g, the area in which the row electrode intersects the column electrode, to the ON state, an ON voltage is applied to a desired column electrode when the row electrode is selected.

Referring specifically to FIGS. 21(*a*)–(*e*), a conventional multiplex drive method of a simple matrix type liquid crystal and more specifically the amplitude selective addressing scheme are shown therein. FIGS. 21(*a*)–(*c*) show the row selection voltage waveforms that is applied in sequence to row electrodes $X_1$, $X_2$ . . . $X_n$, respectively. More particularly, in time period $t_1$, a voltage pulse having a magnitude of $V_1$ is applied to row electrode $X_1$, and a voltage of zero is applied to electrodes $X_2$–$X_n$; in time period $t_2$, a voltage pulse having a magnitude of $V_1$ is applied to row electrode $X_2$ and a voltage of zero is applied to electrodes $X_1$ and $X_3$–$X_n$; and in time period $t_n$, $V_1$ is applied to row electrode $X_n$ and a voltage of zero is to electrodes $X_1$–$X_{n-1}$. In other words, a voltage pulse having a magnitude of $V_1$ is applied to only one row electrode $X_i$ in time $t_i$ Typically, $t_i$ is approximately 69 μseconds and $V_1$ is approximately 25 volts. As will be apparent to one who has read this description, all of the row electrodes are sequentially selected in time periods $t_1$–$t_n$ or one frame period F.

FIG. 21(*d*) shows the waveform applied to column electrode $Y_1$, and FIG. 21(*e*) shows the synthesized voltage waveform applied to the pixel $7_{1,1}$ formed at the intersection of the column electrode $Y_1$ and the row electrode $X_1$. As shown therein, during time period $t_1$, a voltage pulse having a magnitude of $V_1$ is applied to row $X_1$ and a voltage pulse of $-V_2$ is applied to column electrode $Y_1$. Typically, $V_2$ is approximately 1.6 volts. The resultant voltage at pixel $7_{1,1}$ is $-(V_1-V_2)$. This synthesized voltage is sufficient to turn pixel $7_{1,1}$ to its ON state.

One known problem with this method is that in order to select and drive the one line of the row electrodes, a relatively high voltage is required to provide good display characteristics, such as, contrast and low distortion. These conventional displays, requiring such a high voltage, also consume relatively more energy. When such displays are used in portable devices, they are supplied with electrical energy by, for example, batteries. As a result of the higher energy consumption, the portable devices have relatively shorter times of operation before the batteries require replacement and/or recharging.

Various attempts have been made to overcome this problem. For example, it has been suggested in "A Generalized Addressing Technique for RMS Responding Matrix LCDs," 1988 *International Display Research Conference*, pp. 80–85 to simultaneously applying a row selection voltage to more than one row electrode.

As shown in FIGS. 23(*a*)–(*d*), a conventional method for driving a liquid crystal display by simultaneously selecting a group of more than one row electrode is shown. As shown therein, the n row electrodes are divided in j groups of row electrodes, each group comprising, for example, two row electrodes. In this example, row electrodes $X_1$, $X_2$; $X_3$, $X_4$; and $X_{n-1}$, $X_n$, each form a group of row electrodes.

Referring again to FIG. 23(*a*), that figure illustrates row selection voltage waveforms applied simultaneously to both row electrodes $X_1$ and $X_2$ in time periods $t_1$ and $t_2$ and a voltage of zero is applied to row electrodes $X_1$ and $X_2$ in the remaining time periods of frame period F. Similarly, FIG. 23(*b*) indicates the row selection voltage waveforms applied to row electrodes $X_3$ and $X_4$, during time periods $t_3$ and $t_4$ and a voltage of zero is applied to row electrodes $X_3$ and $X_4$ in the other time periods of frame period F. FIG. 23(*c*) illustrates the voltage waveform applied to column electrode $Y_1$, and FIG. 23(*d*) indicates the synthesized voltage waveform applied to the pixel $7_{1,1}$. Generally, $t_1$, $t_2$, . . . $t_n$=69 μseconds, $V_1$ is approximately 17.6 volts and $V_2$ is approximately 2.3 volts.

As shown in the example of FIGS. 23(*a*)–(*d*) every two row electrodes are selected in sequence. In the first selection sequence, two row electrodes, $X_1$ and $X_2$, are selected and row selection voltage waveforms such as that shown in FIG. 23(*a*) are applied to each row electrode. At the same time, the designated column voltage, which is described below, is applied to each column electrode, $Y_1$ to $Y_m$. Next, row electrodes $X_3$ and $X_4$ are simultaneously selected with substantially the same type of waveform voltages as that described above. At the same time, the column voltages $Y_1$ to $Y_m$ are applied to each column electrode. One frame period represents the selection of all row electrodes, $X_1$ to $X_n$. In other words, a complete image is displayed during one frame.

As will be explained hereinbelow, when h row electrodes are simultaneously selected, the voltage waveforms that apply the row electrodes described above use $2^h$ row-select patterns. In the example illustrated in FIGS. 23(*a*)–(*d*), the number of row electrodes simultaneously selected is two, thus the number of row select patterns is $2^2$ or 4.

Moreover, the column voltages applied to each column electrode $Y_1$ to $Y_m$ provide the same number of pulse patterns as that of the row select pulse patterns. That is, there are $2^h$ pulse patterns. These pulse patterns are determined by comparing the states of pixels on the simultaneously selected row electrodes i.e., whether the pixels are ON or OFF, with the polarities of the voltage pulses applied to row electrode.

In this example, as shown in the previously described FIGS. 23(*a*)–(*d*), when row electrodes $X_1$ and $X_2$ are selected and row voltages such as those in FIG. 23(*a*) and FIG. 24(*a*) are applied thereto and when the pixels on row electrodes $X_1$ and $X_2$ are ON and OFF, respectively, the voltage waveform applied the column electrode is voltage waveform $Y_a$ shown in FIG. 24(*b*). When the pixels are OFF and ON, respectively, the column voltage waveform $Y_b$ is applied to the column electrode. In another example, when the pixels are both ON, a voltage waveform $Y_c$ is applied to the column electrode. Finally, when both pixels are OFF, the a column voltage waveform $Y_d$ is applied to the column electrode.

The above-mentioned column voltage waveforms $Y_a$–$Y_d$ are determined as follows. At first, each pixel simultaneously selected is defined to have a first value of 1 when the voltage applied by the row electrode to the corresponding selected pixel is positive or a first value of −1 when the row electrode is negative. Each of the selected pixels is defined to have a second value of −1 when the display state is ON or a second value of 1 when display state is OFF. The first value is compared to the second value bit-by-bit, the difference between the number of matches, i.e., when the first value equals the second value, and the number of mismatches, i.e., when the first value does not equal the second value, is calculated. When the difference between the number of matches and mismatches for the simultaneously selected rows is two, $V_2$ is applied; when 0, $V_0$ is applied; and when −2, $-V_2$ is applied.

For example, when the pulse waveforms shown in FIG. 23(*a*) are applied to row electrodes $X_1$ and $X_2$, a column voltage having the waveform of $Y_a$ is applied. This column voltage is determined as follows. The pixels formed at the intersections of column electrode $Y_1$ and rows electrodes $X_1$ and $X_2$ are in the ON and OFF states, respectively. For the purposes of this discussion, these pixels will be referred to as the first and second pixels, respectively. In other words, the first pixel has a second value of −1 and the second pixel has a second value of 1. During the period $t_a$, the first pixel has a first value of −1 and the second pixel has a first value of −1, since the row voltages $X_1$ and $X_2$ are both $-V_1$. Referring to the first pixel, since the first value is −1 and the second value is −1, there is a match. With regard to the second pixel, the first value is −1 and the second value is 1, thereby forming a mismatch. The difference between the number of mismatches and matches is 1—1 or zero. Therefore, a voltage of 0 (zero) is applied to the column electrode in time $t_a$. Next, concerning the pulse waveforms of the time interval $t_b$, the applied voltage of row electrode $X_1$ is positive and the applied voltage of row electrode pulse $X_2$ is negative. Using a similar analysis as described above, the number of matches is zero and the number of mismatches is 2. Thus, $-V_2$ volts will be applied to the second half of time interval $t_1$.

As should now be apparent, the first values in time interval $t_c$ in FIG. 23(*a*) are −1 and 1 because the applied voltage of row electrode $X_1$ is negative and the applied voltage of row electrode $X_2$ is positive. When these are compared with the second values of the first and second pixels of −1 and 1, the number of matches is two and the number of mismatches is zero. The difference between the number of matches and the number of mismatches is 2. Thus, the column voltage of $V_2$ volts will be applied in time interval $t_c$.

In time interval $t_d$, the applied voltage of row electrodes $X_1$ and $X_2$ are both positive. Thus, the first values are 1 and 1. When compared to the pixel states of −1 and 1, the number of matches is 1 and the number of mismatches is 1, thus the difference between the number of matches and the number of mismatches is zero. Accordingly, zero volts will be applied to $Y_a$ for the time interval $t_d$.

A summary of this analysis for time periods $t_a$, $t_b$, $t_c$ and $t_d$, is shown in Table A below:

TABLE A

| | $t_a$ | $t_b$ | $t_c$ | $t_d$ |
|---|---|---|---|---|
| pixel | | | | |
| 1 — ON | | | | |
| first value | −1 | 1 | −1 | 1 |
| second value | −1 | −1 | −1 | −1 |
| match | yes | no | yes | no |
| mismatch | no | yes | no | yes |
| 2 — OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 1 | 0 | 2 | 1 |
| no. of mismatches | 1 | 2 | 0 | 1 |
| difference | 0 | −2 | 2 | 0 |
| column voltage | 0 | $-V_2$ | $V_2$ | 0 |

As is readily apparent, the column voltage $Y_a$ corresponds to the column voltage pattern and is applied to the column to place the first pixel in its ON state and the second pixel in its OFF state.

As for the other column voltage waveforms, $Y_b$ to $Y_d$, the voltages are selected under the same criteria as described above and are summarized in Tables B, C and D hereinbelow:

TABLE B

| | $t_a$ | $t_b$ | $t_c$ | $t_d$ |
|---|---|---|---|---|
| pixel | | | | |
| 1 — OFF | | | | |
| first value | −1 | 1 | −1 | 1 |
| second value | 1 | 1 | 1 | 1 |
| match | no | yes | no | yes |
| mismatch | yes | no | yes | no |

TABLE B-continued

| | $t_a$ | $t_b$ | $t_c$ | $t_d$ |
|---|---|---|---|---|
| 2 — ON | | | | |
| first value | −1 | −1 | 1 | 1 |
| second value | −1 | −1 | −1 | −1 |
| match | yes | yes | no | no |
| mismatch | no | no | yes | yes |
| no. of matches | 1 | 2 | 0 | 1 |
| no. of mismatches | 1 | 0 | 2 | 1 |
| difference | 0 | −2 | 2 | 0 |
| column voltage | 0 | $-V_2$ | $V_2$ | 0 |

Column Voltage Applied = $Y_b$

TABLE C

| | $t_a$ | $t_b$ | $t_c$ | $t_d$ |
|---|---|---|---|---|
| pixel | | | | |
| 1 — ON | | | | |
| first value | −1 | 1 | −1 | 1 |
| second value | −1 | −1 | −1 | −1 |
| match | yes | no | yes | no |
| mismatch | no | yes | no | yes |
| 2 — ON | | | | |
| first value | −1 | −1 | 1 | 1 |
| second value | −1 | −1 | −1 | −1 |
| match | yes | yes | no | no |
| mismatch | no | no | yes | yes |
| no. of matches | 2 | 1 | 1 | 0 |
| no. of mismatches | 0 | 1 | 1 | 2 |
| difference | 2 | 0 | 0 | −2 |
| column voltage | $V_2$ | 0 | 0 | $-V_2$ |

Column Voltage Applied = $Y_c$

TABLE D

| | $t_a$ | $t_b$ | $t_c$ | $t_d$ |
|---|---|---|---|---|
| pixel | | | | |
| 1 — OFF | | | | |
| first value | −1 | 1 | −1 | 1 |
| second value | 1 | 1 | 1 | 1 |
| match | no | yes | no | yes |
| mismatch | yes | no | yes | no |
| 2 — OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 0 | 1 | 1 | 2 |
| no. of mismatches | 2 | 1 | 1 | 0 |
| difference | −2 | 0 | 0 | 2 |
| column voltage | $-V_2$ | 0 | 0 | $V_2$ |

Column Voltage Applied = $Y_d$

In the examples above, the first value is 1 when the row-select voltage has a positive polarity or the first value when the row-select voltage has a negative polarity. Additionally, the second value is −1 when the display state of the pixel is ON, or 1 when the display state is OFF. The column voltage waveforms were selected by means of the difference between the number of matches and the number of mismatches. As will be appreciated by one of ordinary skill in the art, the sign conventions may be inverted. Moreover, it also is possible to set the column voltage waveforms with only the number of matches or the number of mismatches, without having to calculate the difference between the number of matches and the number of mismatches as explained below.

FIGS. 25(*a*)–(*d*) illustrate another example of the prior art in which a plurality of row electrodes are divided into groups of row electrodes. The groups of row electrodes are selected in sequence and the row electrodes within each group are simultaneously selected. In this example, each group comprises three row electrodes that are simultaneously selected in order to generate a display pattern, as shown in FIG. 26.

In other words, initially three row electrodes, $X_1$, $X_2$ and $X_3$, are selected and row selection voltages such as those shown in FIG. 25(*a*) are applied to these row electrodes, $X_1$, $X_2$ and $X_3$, respectively. At the same time, the designated column voltages, to be discussed later, are applied to each column electrode $Y_1$ to $Y_m$. Next, row electrodes $X_4$, $X_5$ and $X_6$, shown in FIG. 26, are selected and row selection voltages such as that in FIG. 25(*b*) are applied to these electrodes in the same manner as described above. At the same time, column voltages are applied to each column electrode, $Y_1$ to $Y_m$. As with the previous example, one frame period F is defined as the selection of all of the row electrodes, X1 to $X_n$. One image is completely displayed in one frame period, and plural images can be display by repeating this cycle continuously.

When each row voltage waveform described above has h as the number of row electrodes that are simultaneously selected, as in previous example, the number of $2^h$ row-select pattern are used. In this example, the number of $2^3$ or 8 patterns are used.

Moreover, as in the previous example, the column voltages applied to each column electrode, $Y_1$ to $Y_m$, are the same as the number of row-select patterns. Also, the voltage level of each pulse is such that the voltage that corresponds to the numbers of the ON state and the OFF state of the selected row electrodes is applied. In other words, the column voltage level is determined by comparing the row-select pattern and display pattern. Thus, for example, when the row voltage waveforms applied to row electrodes $X_1$, $X_2$ and $X_3$, which are selected simultaneously in this example, have a positive pulse, they are ON, and when they have a negative pulse, they are OFF. The ON and the OFF of the display data are compared at each pulse and the column voltage waveforms are set according to the number of mismatches.

In other words, in the example of FIGS. 25(*a*)–(*d*), when the number of mismatches is zero, $-V_3$ volts are applied; when it is 1, $-V_2$ volts are applied; when it is 2, $V_2$ volts are applied; and when it is 3, $V_3$ volts are applied. The voltage ratios for $V_2$ and $V_3$ above are preferably such that $V_2:V_3$= 1:3.

In specific terms, in the case of the voltage waveforms applied to row electrodes $X_1$, $X_2$ and $X_3$ in FIG. 25(*a*), those waveforms are ON when the $V_1$ volts are applied and OFF when the $-V_1$ volts are applied. Referring to FIG. 26, the pixel is indicated as ON when there is a closed circle and OFF when there is a open circle. As shown in FIG. 26, the display states of the pixels that cross with column electrode $Y_1$ and row electrodes $X_1$, $X_2$ and $X_3$ are ON, ON and OFF, respectively. In contrast to this, the initial pulse pattern of the voltage applied to each row electrode, $X_1$, $X_2$ and $X_3$, is OFF, OFF and OFF, respectively. Comparing both in sequence, the number of mismatches is 2. Therefore, $V_2$ volts are applied to the initial pulse pattern of the voltage applied to each row electrode $Y_1$, as shown in FIG. 25(*c*). Using a similar analysis, the second pulse pattern of the voltage that is applied to each row electrode, $X_1$, $X_2$ and $X_3$, is OFF, OFF and ON, respectively. When compared in sequence the voltage pattern with the ON, ON and OFF sequence of the aforesaid pixel display pattern, all are mismatching. Since the number of mismatches is 3, voltage $V_3$ is applied to the second pulse of column electrode $Y_1$. As will be understood by one of ordinary skill in the art, by applying the above described analysis to the third and fourth time intervals, column voltages $-V_2$ and $-V_2$ are applied therein. Thus, a column voltage of $-V_3$, $V_2$, $-V_2$ and $-V_2$ is applied to provide the pixel states as shown in FIG. 26.

In the next time period, the next three row electrodes $X_4$ to $X_6$, are selected by applying selection voltages thereto, as shown in FIG. 25(*b*). In accordance with the analysis described above, column voltages have the voltage levels that corresponds to the number of mismatches between the ON and OFF display states of the pixels formed at the intersection of the row electrodes $X_4$ to $X_6$ and the column electrode, and the ON and OFF states of pulse patterns of the synthesized voltages. FIG. 25(*d*) illustrates the resultant voltage waveforms that are applied to the pixels at the intersection of the row electrode $X_1$ and column electrode $Y_1$. That is, the synthesized waveform is resultant of the voltage waveform applied to row electrode $X_1$ and the voltage waveform applied to column electrode $Y_1$.

As indicated above, the method that simultaneously selects a plurality of row electrodes in a group and the selection of each group in sequence, has the advantage of the reducing the drive voltage level.

Referring now to FIG. 27, the relationship between the transmissitivity of a pixel of a liquid crystal display and the applied voltage is shown therein. In a liquid crystal display driven in a conventional manner, after the selection voltage has been applied to a particular pixel, during the period until the next selection voltage is applied to that pixel, the brightness gradually decreases during the time t. This reduces the transmissitivity T in the ON condition and, on the other hand, slightly increase the transmissitivity T in the OFF condition. As shown in FIG. 21, such conventional displays have poor contrast between the ON condition and the OFF condition.

The following is a general discussion regarding the conventional method for simultaneously selecting multiple row electrodes.

A. Reguirements (a) The N number of row electrodes to be displayed are divided up into N/h non-intersecting subgroups.

(b) Each subgroup has h number of address lines.

(c) At a particular time, the display data on each column electrode is composed of an h-bit words, e.g.:

$$d_{k*h+1}, d_{k*h+2} \ldots d_{k*h+h};\ d_{k*h+j}=0 \text{ or } 1$$

Where $0 \leqq k \leqq (N/h)-1$ (k: subgroup)

In other words, one column of display data is:

$d_1, d_2 \ldots d_h \ldots$ Subgroup 0

$d_{h+1}, d_{h+2} \ldots d_{h+h} \ldots$ Subgroup 1

$d_{N-h+1}, d_{N-h+2} \ldots d_{N-h+h} \ldots$ Subgroup N/h−1

(d) The row-select pattern has $2^h$ cycle and is represented by an h-bit words, e.g.:

$$a_{k*h+1}, a_{k*h+2} \ldots a_{k*h+h};\ a_{k*h+j}=0 \text{ or } 1$$

B. Guidelines (1) One subgroup is selected simultaneously for addressing.

(2) One h-bit word is selected as the row-select pattern.

(3) The row-select voltages are:

$-V_r$ for a logic 0, $+V_r$ for a logic 1, 0 volts or ground for the non selected period.

(4) The row-select patterns and the display data patterns in the selected subgroup are compared bit by bit such as with digital comparators, viz. exclusive OR logic gates.

(5) The number of mismatches i between these two patterns is determined by counting the number of exclusive-OR logic gates having a logical 1 output.

Steps 1–4 are summarized by the following equation:

$$i = \sum_{j=1}^{h} a_{k*h+j} \oplus d_{k*h+j} \quad (0 \leq i \leq h)$$

(where $\oplus$ is an exclusive OR logic operation)

(6) The column voltage is chosen to be V(i) when the number of mismatches is i.

(7) The column voltages for each column in the matrix is determined independently by repeating the steps (4)–(6).

(8) Both the row voltage and column voltage are applied simultaneously to the matrix display for a time duration $\Delta t$, where $\Delta t$ is minimum pulse width.

(9) A new row-select pattern is chosen and the column voltages are determined using steps (4)–(6). The new row and column voltages are applied to the display for an equal duration of time at the end of $\Delta t$.

(10) A frame or cycle is completed when all of the subgroups (=N/h) are selected with all the $2^h$ row-select patterns once.

$$1 \text{ cycle} = \Delta t \cdot 2^h \cdot N/h$$

C. Analysis

The row select patterns in a case in which there are i number of mismatches will now be considered. The number of h-bit row-select patterns which differ from and h-bit display data pattern by i bits is given by $$hCi = h!/\{i!(h-i)!\} = Ci$$

For example, when the case for h=3 and row electrode selection pattern=(0,0,0) is considered, the results would be as shown in the table below:

| Mismatching number | : Display Data pattern | : Ci |
|---|---|---|
| i = 0 | : (0,0,0) | : 1 way |
| i = 1 | : (0,0,1) (0,1,0) (1,0,0) | : 3 ways |
| i = 2 | : (1,1,0) (1,0,1) (0,1,1) | : 3 ways |
| i = 3 | : (1,1,1,) | : 1 way |

These are determined by the number of bits of a word, not the row electrode selection patterns.

If the amplitude $V_{pixel}$ of the instantaneous voltage that is applied to the pixel had a row voltage of $V_{row}$ and column voltage of $V_{column}$, the synthesized voltage would be as follows:

$$V_{pixel} = (V_{column} - V_{row}) \text{ or } (V_{row} - V_{column})$$

Where, if $V_{row} = \pm V_r$ and $V_{column} = V(i)$, then $V_{pixel} = +V_r - V(i)$ or $-V_r - V(i)$.

If $V_{row} = \pm V_r$ and $V_{column} = \pm V(i)$, then $V_{pixel} = V_r - V(i)$, $V_r + V(i)$, $-V_r - V(i)$ or $-V_r + V(i)$.

That is:

$$V_{pixel}=|V_r-V(i)| \text{ or } |V_r+V(i)|$$

As a consequence, the specific amplitude to be applied to the pixel is either $-(V_r+V(i))$ or $(V_r-V(i))$ in the selection row and is V(i) in the non-selection row.

In general, in order to achieve a high selection ratio, it is desirable that the voltage across a pixel should be as high as possible for an ON pixel and as low as possible for an OFF pixel.

As a result, when a pixel is in the ON state, the voltage $|V_r+V(i)|$ is favorable for the ON pixel, and the voltage $|V_r-V(i)|$ is unfavorable for the ON pixel. On the other hand, when a pixel is in the OFF state, the voltage $|V_r-V(i)|$ is favorable for the OFF pixel, and the voltage $|V_r+V(i)|$ is unfavorable for the OFF pixel.

Here, it is favorable for the ON pixel to increase the effective voltage and unfavorable for the ON pixel to decrease the effective voltage. The number of combinations that selects i units from among the h bits is:

$$Ci=hCi=\{h!\}/\{i!(h-i)!\}$$

The total number of mismatches provides the number of unfavorable voltages in the selected rows in a column. The total number of mismatches is i·Ci in Ci row select patterns considered are equally distributed over the h pixels in the selected rows. Hence the number of unfavorable voltages per pixel (Bi) when number of mismatches is i can be obtained as given following;

$$Bi=i\cdot Ci/h(\text{units/pixel})$$

The number of times a pixel gets a favorable voltage during the Ci time intervals considered is:

$$Ai=\{(h-i)/h\}\cdot Ci$$

In addition:

$$\{(h-i)/h\}\cdot Ci+(i/h)\cdot Ci=(h/h)\ Ci=Ci$$

Accordingly, the following is obtained:

$$Ai=Ci-Bi=\{(h-1)!\}/\{i!\cdot(h-i-1)!\}$$

Where: $h \leqq i+1$.

To summarize the above:

$$V_{on\ (rms)}=\{(S1+S2+S3)/S4\}^{1/2}$$

$$V_{off\ (rms)}=\{(S5+S6+S3)/S4\}^{1/2}$$

$$S_1=\sum_{i=0}^{h} Ai(V_r+V(i))^2 \quad \text{(favorable)}$$

$$S_2=\sum_{i=0}^{h} Bi(V_r-V(i))^2 \quad \text{(unfavorable)}$$

$$S_3=\{(N/h)-1\}\sum_{i=0}^{h}(Ai+Bi)V(i)^2$$

$$S_4=2^h\cdot(N/h)$$

$$S_5=\sum_{i=0}^{h} Ai(Vr-V(i))^2 \quad \text{(favorable)}$$

-continued $$S_6=\sum_{i=0}^{h} Bi(Vr-V(i))^2 \quad \text{(unfavorable)}$$

In addition:

$V_r/V_o=N^{1/2}/h$ . . . row selection voltage $V(i)/V0=(h-2i)/h=\{1-(2i/h)\}$ . . . column voltage, and $R=(V_{on}/V_{off})_{max}=\{(N^{1/2}+1)/(N^{1/2}-1)\}^{1/2}$.

As noted above and as shown in FIG. 27, however, a liquid crystal display driven according to such a method has poor contrast between its ON and OFF states.

Moreover, as shown in FIG. 25, in such conventional driving methods, the pulse width applied to the row electrodes and the column electrodes narrows as the number of simultaneously selected row electrodes increases, and this increases the amount of crosstalk due to the distortion of the waveforms. This results in, for example, poor image quality. This problem becomes even more serious, for example, in a case in which gray shade display, which is caused by the pulse width modulation (PWM), takes place.

OBJECTS OF THE INVENTION

It is an object of the present invention to provide an apparatus that obviates the aforementioned problems of the conventional liquid crystal devices.

It is a further object of the present invention to provide a liquid crystal display for displaying an image having high image quality.

It is another object of the present invention to provide a liquid crystal display with good contrast characteristics.

It is still another object of the present invention to provide a display with a reduced number of column voltage levels.

These and other objects, features and advantages of the present invention will become more apparent upon a consideration of the following detailed description of the preferred embodiments of the present invention in conjunction with the accompanying drawings.

Although the detailed description and annexed drawings describe a number of preferred embodiments of the present invention, it should be appreciated by those skilled in the art that many variations and modifications of the present invention fall within the spirit and scope of the present invention as defined by the appended claims.

SUMMARY OF THE INVENTION

According to an aspect of the present invention, a multiplex driving method is provided for a liquid crystal display device having a liquid crystal layer disposed between a pair of substrates, a plurality of row electrodes arranged on one of the substrates and a plurality of column electrodes arranged on the other substrate. The method comprises the steps of sequentially selecting a group of the plurality of row electrodes in a selection period, simultaneously selecting the row electrodes comprising each group, and dividing and separating the selection period into a plurality of intervals within one frame period.

By adopting such a driving method, for example, after a selection voltage has been applied to a particular pixel in the initial frame, the voltage will be applied to that pixel several times during the period until the selection voltage is applied to that pixel in the next frame. This makes it possible to maintain brightness and prevent a reduction in contrast.

According to another aspect of the present invention, a first portion of a selection signal is sequentially applied to each of j groups of row electrodes in a first selection period of a frame, such that the first portion of the selection signal is simultaneously applied to i row electrodes in each of the j groups. A second portion of the selection signal is sequentially applied to the j groups of row electrodes in a second selection period of the frame, such that the second portion of the selection signal is simultaneously applied to the i row electrodes in each of the j groups.

According to a further aspect of the present invention, a display apparatus is provided comprising a display having a plurality of row electrodes and column electrodes, the row electrodes being arranged in groups. A drive circuit comprises a row electrode data generating circuit for generating row selection pulse data and a frame memory for providing display data. An arithmetic operation circuit calculates converted data in accordance with the row selection pulse data generated by the drive circuit and the display data provided by the frame memory. A column electrode driver is responsive to the converted data calculated by the arithmetic operation circuit for generating column data for the plurality of column electrodes. A row electrode driver is responsive to the row selection pulse data generated by said drive circuit for selecting in sequence each of the groups of row electrodes. The row electrodes comprising each of the groups are selected simultaneously, and scanning of one screen is performed a plurality of times in accordance with the row selection pulse data and the display data during one frame period. By having a drive circuit such as that described above, it is possible to execute the drive method described above easily and reliably.

In accordance with such a display device, the display device has a driving circuit which performs the steps of calculating the row-select pattern generated by the row electrode data generation circuit and the display data pattern on the plurality of row electrodes which are read in sequence from the frame memory. The row electrodes are then selected simultaneously with the row-select pattern. The driving circuit transfers the converted data, which is the result of the calculation, to the column electrode driver, and transfers the row data, which is generated by the row electrode data generation circuit, to the row electrode driver. Further, the driving circuit repeats the above-mentioned operation by the next row-select pattern data and display data pattern when scanning of one image is finished. The screen operation is repeated several times in one frame period. Thus, the display device according to the present invention has excellent contrast characteristics.

According to still yet a further aspect of the present invention, a method is provided for determining a number of voltage levels applied to each of m column electrodes in a liquid crystal display having a pair of opposing substrates, n row electrodes disposed on one of the substrates and the m column electrodes disposed on the other of the substrates, and a liquid crystal material disposed between the pair of substrates, n×m pixels being formed at the intersection of the n row electrodes and the m column electrodes. The n row electrodes are divided into j groups, each group having at least i row electrodes, i, j, n and m being positive integers greater than 1, i being less than n and j being less than n. A selection signal is applied sequentially to each of the j groups of row electrodes and simultaneously applied to each of the i row electrodes in a plurality of time periods for displaying an image in a frame period. The method comprising the step of, for each of the time periods, determining a first number of mismatches between the selection signal applied to the i row electrodes and display states of the pixels formed at the intersections of the i row electrodes and one of the m columns electrodes. A virtual selection signal is applied to a virtual row electrode and a second number of mismatches between the virtual selection signal applied to the virtual electrode and a display state of a virtual pixel formed at the intersection of the one column electrode and the virtual row electrode is determined. A third number of mismatches is defined by the sum of the first and second number of mismatches, and the virtual selection signal has a waveform and the virtual pixel has a display state such that the third number of mismatches is either an odd number or an even number. A number of matches between the selection signal applied to the i row electrodes and the display states of the pixels at the intersections of the i row electrodes and the one column electrode and between the virtual selection signal applied to the virtual row electrode and the display state of the virtual pixel formed at the intersection of the virtual electrode and the one column electrode is determined. The voltage level for each time period is a level corresponding to the difference between the third number of mismatches and the number of matches. The above-discussed process is repeated for each of the time periods.

BRIEF DESCRIPTION OF THE DRAWINGS

In the drawings, wherein like reference characters denote similar elements throughout the several views.

FIG. 2 shows a top view of a general configuration of the liquid crystal display.

FIG. 3 is a graph illustrating the relationship between the applied voltage of a pixel and the transmissitivity thereof according to the first embodiment of FIGS. (*a*)–(*d*).

FIG. 6 is a block diagram of the column electrode driver of the column driving circuit of FIG. 4.

FIG. 9 illustrates the display patterns in accordance with the present invention.

FIGS. 10(*a*)–(*b*) show the applied row selection and column electrode voltage waveforms which correspond to the display patterns of FIG. 9.

FIG. 12 illustrates the display patterns in accordance with the present invention.

FIG. 13(*a*) illustrates the applied row selection voltage waveforms that are applied to the row electrodes according to the embodiment of FIG. 11.

FIG. 13(*b*) shows the applied column voltage waveforms that are applied to the column electrodes that correspond to the display patterns of FIG. 12 .

FIGS. 16(*a*)–(*d*) shows another example of the applied voltage waveforms in accordance with the present invention.

FIG. 20 illustrates the display pattern of a liquid crystal display having virtual electrodes in accordance with the seventh embodiment.

FIGS. 21(*a*)–(*e*) show the applied voltage waveforms of a conventional driving method of a liquid crystal display.

DESCRIPTION OF THE PREFERRED EMBODIMENTS

Figure 4:
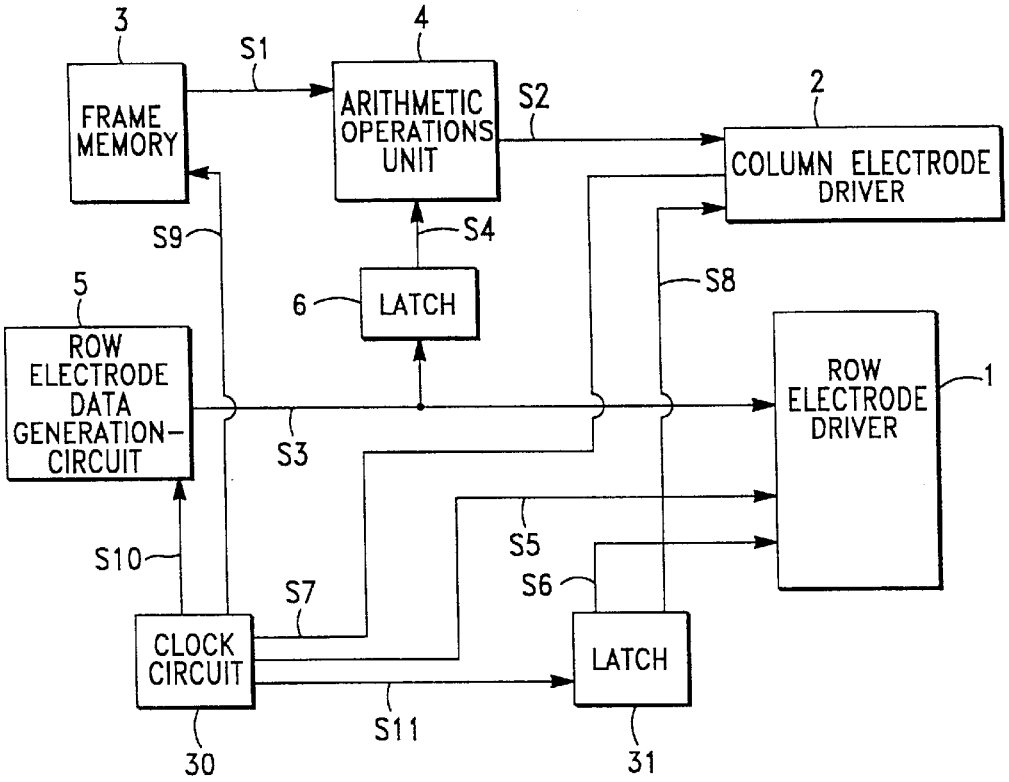
FIG. 4 is a block diagram of a driving circuit in accordance with embodiments 1–7 of the present invention.
Figure 5:
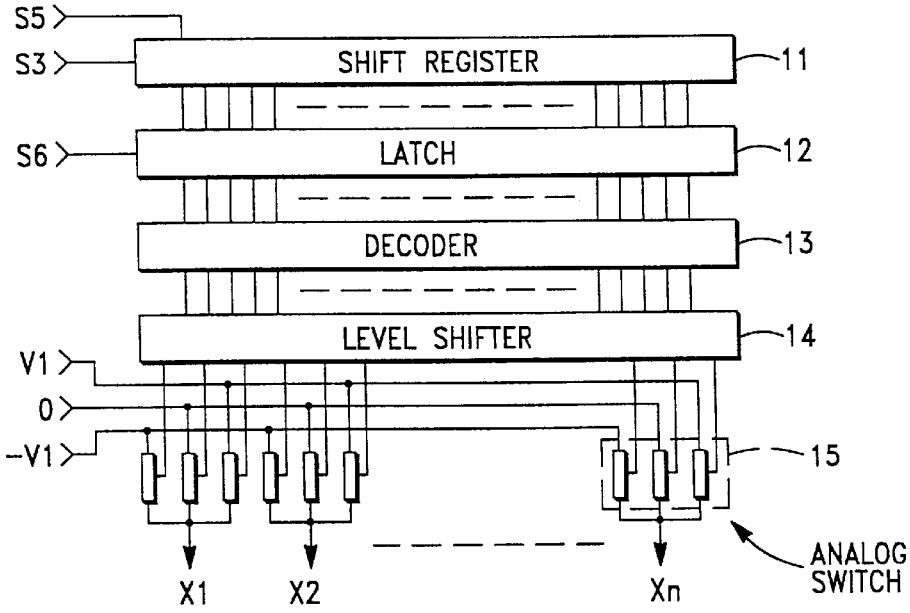
FIG. 5 is a block diagram of the row electrode driver of the row driving circuit of FIG. 4.
Figure 22:
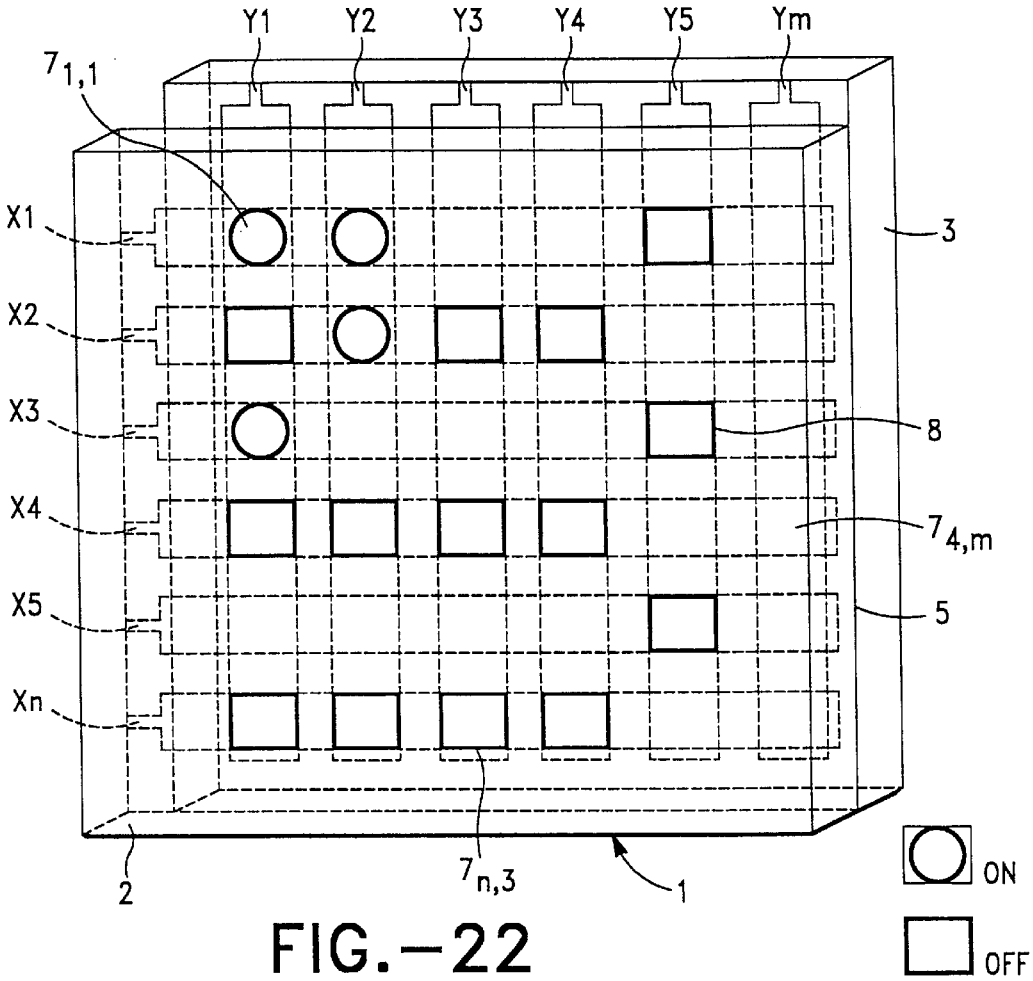
FIG. 22 illustrates a liquid crystal display panel.
Figure 26:
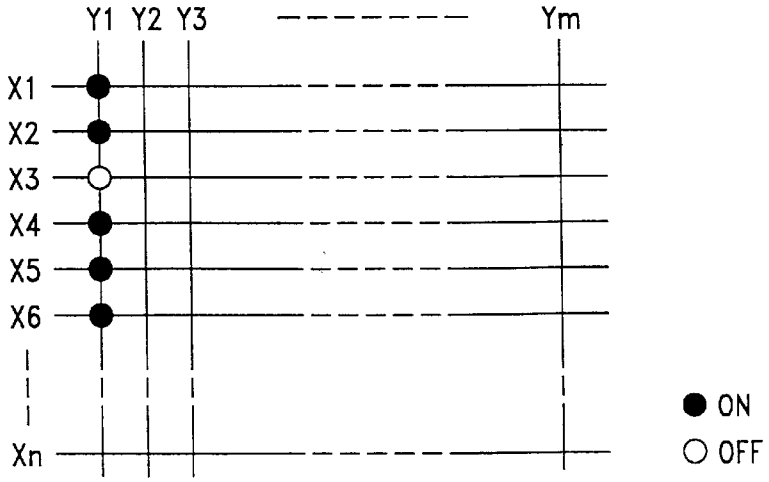
FIG. 26 illustrates an example of a display pattern.

Referring to FIGS. 4–6, a preferred example of a liquid crystal panel driving circuit according to the present invention is illustrated. More specifically, FIG. 4 illustrates a preferred drive circuit, FIG. 5 illustrates a preferred row electrode driver circuit and FIG. 6 illustrates a preferred column electrode driver circuit. Of course, while the circuits of FIGS. 4–6 are preferred, persons of ordinary skill in the art who have read this description will recognize that various modifications and changes may be made therein. The driving circuit is for driving a liquid crystal display panel 1, as shown in FIG. 22. In the preferred embodiment, the liquid crystal display panel comprises m column electrodes, $Y_1$–$Y_m$, and n row electrodes, $X_1$–$X_n$. The intersections of the m column electrodes and n row electrodes form n×m pixels. In the preferred embodiment the n row electrodes are arranged in j groups of row electrodes, and each of the j groups of row electrodes comprise i row electrodes. In accordance with the invention, each of the j groups of row electrodes are selected sequentially, and each of the i row electrodes within each group are simultaneously selected. A detailed explanation of the driving method is presented hereinbelow.

Turning to FIG. 4, reference numeral 1 denotes the row electrode driver and reference numeral number 2 represents the column electrode driver. Details of the row and column electrode driver circuits will be explained hereinbelow and are shown in FIGS. 5 and 6, respectively. Reference numeral 3 represents the frame memory, reference numeral 4 represents an arithmetic operations circuit; reference numeral 5 represents a row electrode data generation circuit; reference numeral 30 represents a clock circuit; reference numeral 6 represents a first latch and reference numeral 31 represents a second latch circuit.

FIG. 5 illustrates a block diagram of the row electrode driver 1. In this drawing, reference numeral 11 is a first shift register; reference numeral 12 is a third latch circuit; reference numeral 13 is a first decoder circuit; reference numeral 14 is a first level shifter; and reference numeral 15 are first analog switches.

FIG. 6 is a block diagram of the column electrode driver 2. In this drawing, reference numeral 21 is a second shift register; reference numeral 22 is a fourth latch circuit; reference 23 is a second decoder; reference numeral 24 is a second level shifter; and reference numeral 25 are second analog switches.

The operation of the liquid crystal display panel will now be described with respect to FIGS. 4–6. Initially, a clock circuit 30 provides appropriate timing signals to row electrode generator 5, signal S10, to row driver 1, signal S5, to column driver 2, signal S7, and to second latch circuit 31, signal S11.

Row electrode generator 5 generates a row-select pattern S3 for sequentially selecting a group of row electrodes and for simultaneously selecting the row electrodes within each group to row driver 1. As shown in FIG. 5, the row select pattern is transferred to the first shift register 11 in accordance with clock signal S3. After the data for each row electrode in one scanning period has been transferred to the first shift register 11, each data is latched in the third latch circuit 12 by latch signal S6 from the second latch circuit 31. The data is then decoded by decoder 13 and the appropriate voltage level is selected by the first level shifter 14 and the first analog switches 15. The voltages selected are from among $-V_1$, 0 and $V_1$. More specifically, when a positive level has been selected, $V_1$ volts is supplied to the selected row electrodes and when a negative level has been selected, $-V_1$ volts is supplied to the selected row electrodes. During the non-selected period, a voltage of zero is supplied to row electrodes. The selected voltages are applied to the row electrodes in accordance with the methods described below.

Image data generated by, for example, a CPU (not shown) is stored in frame memory 3. A display data signal S1, which corresponds to each of the row electrodes selected simultaneously, is read from memory 3 for providing each column voltage waveform. As shown in FIG. 4, the row-select pattern signal S3 is latched by the first latch circuit 6. The display data signal S1 and the latched row-select pattern data signal S4 are converted by arithmetic operations circuit 4. Data conversion by arithmetic operations circuit 4 is performed in accordance with, for example, embodiments one to seven described hereinbelow. The converted data S2 is then transferred to column electrode driver 2.

Figure 4A:
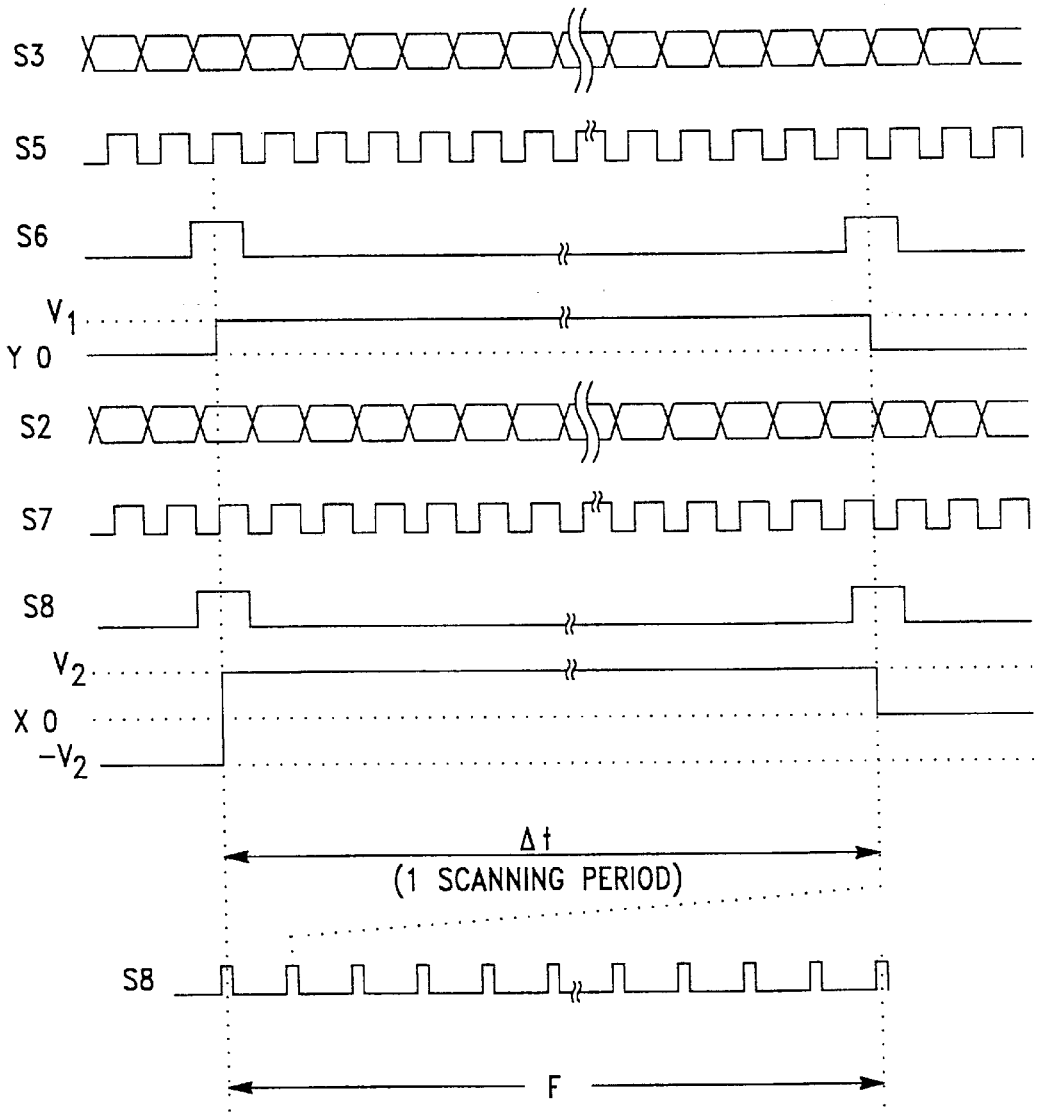
FIG. 4A is a timing diagram of the driving circuit of FIG. 4.

As shown in FIG. 6, data signal S2 from arithmetic operations circuit 4 is transferred to the second shift register 21 in accordance with shift clock signal S7. After each row electrode data during one scanning period has been transferred, each data will be latched by fourth latch circuit 22 in accordance with latch signal S8. The data is then decoded by the second decoder circuit 23. An appropriate voltage level is selected by the second level shifter 24 and second analog switches 25. In other words one of three voltage levels is selected by analog switches 25, e.g. $V_2$ volts, $-V_2$ volts or zero volts. A timing diagram of the aforementioned signals is shown in FIG. 4A.

First Embodiment

A driving method for a liquid crystal display in accordance with a first embodiment of the present invention will now be described. As will be apparent to one of ordinary skill in the art, the driving method may be implemented in a driving circuit as discussed above.

Figures 1A, 1B, 1C, 1D:
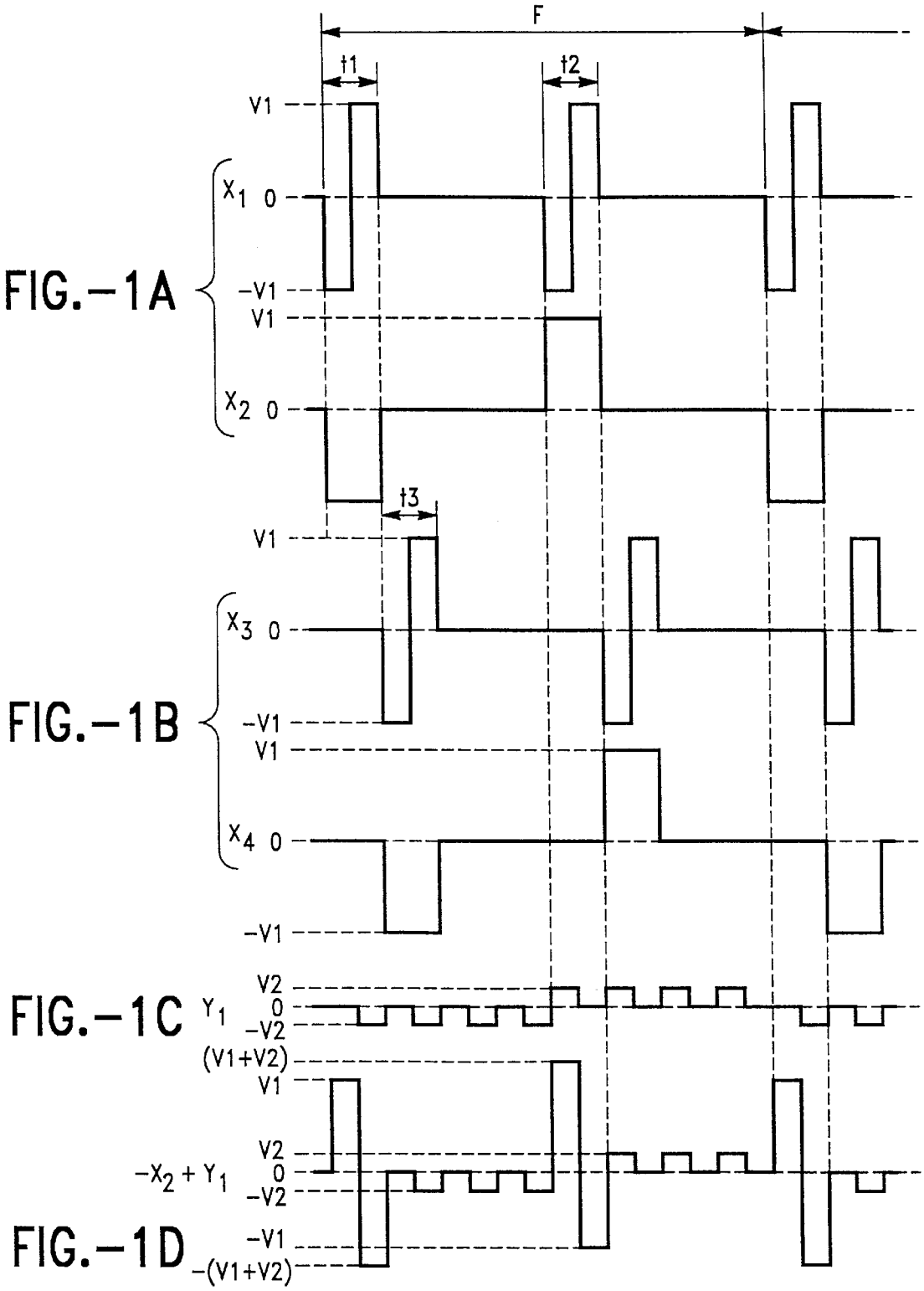
FIGS. 1(*a*)–(*d*) show the applied voltage waveforms in accordance with the first embodiment of a driving method of the liquid crystal display according to the present invention.

Referring to FIGS. 1(*a*)–(*d*), waveforms for driving a liquid crystal display panel are shown therein. Specifically, FIG. 1(*a*) illustrates row selection voltage waveforms applied to row electrodes $X_1$ and $X_2$, FIG. 1(*b*) illustrates row selection voltage waveforms applied to row electrodes $X_3$ and $X_4$, FIG. 1(*c*) illustrates voltage waveforms applied to column electrode $Y_1$, and FIG. 1(*d*) shows the synthesized voltage waveforms applied to a pixel formed at an intersection of row electrode $X_1$ and column electrode $Y_1$.

FIG. 2 shows a top view of a general configuration of the liquid crystal display panel having a liquid crystal material arranged between a pair of substrates. As shown in that figure, pixels or picture elements are formed at the intersections of the column and row electrodes. In FIG. 2 those pixels having a circle are in the ON state and the other pixels are in the OFF state.

In accordance with the first embodiment, the row selection period comprises two intervals or portions. That is, the row electrodes are selected twice within one selection period or one frame period F. It is during the one frame period F that a complete image is displayed.

Figures 23A, 23B, 23C, 23D:
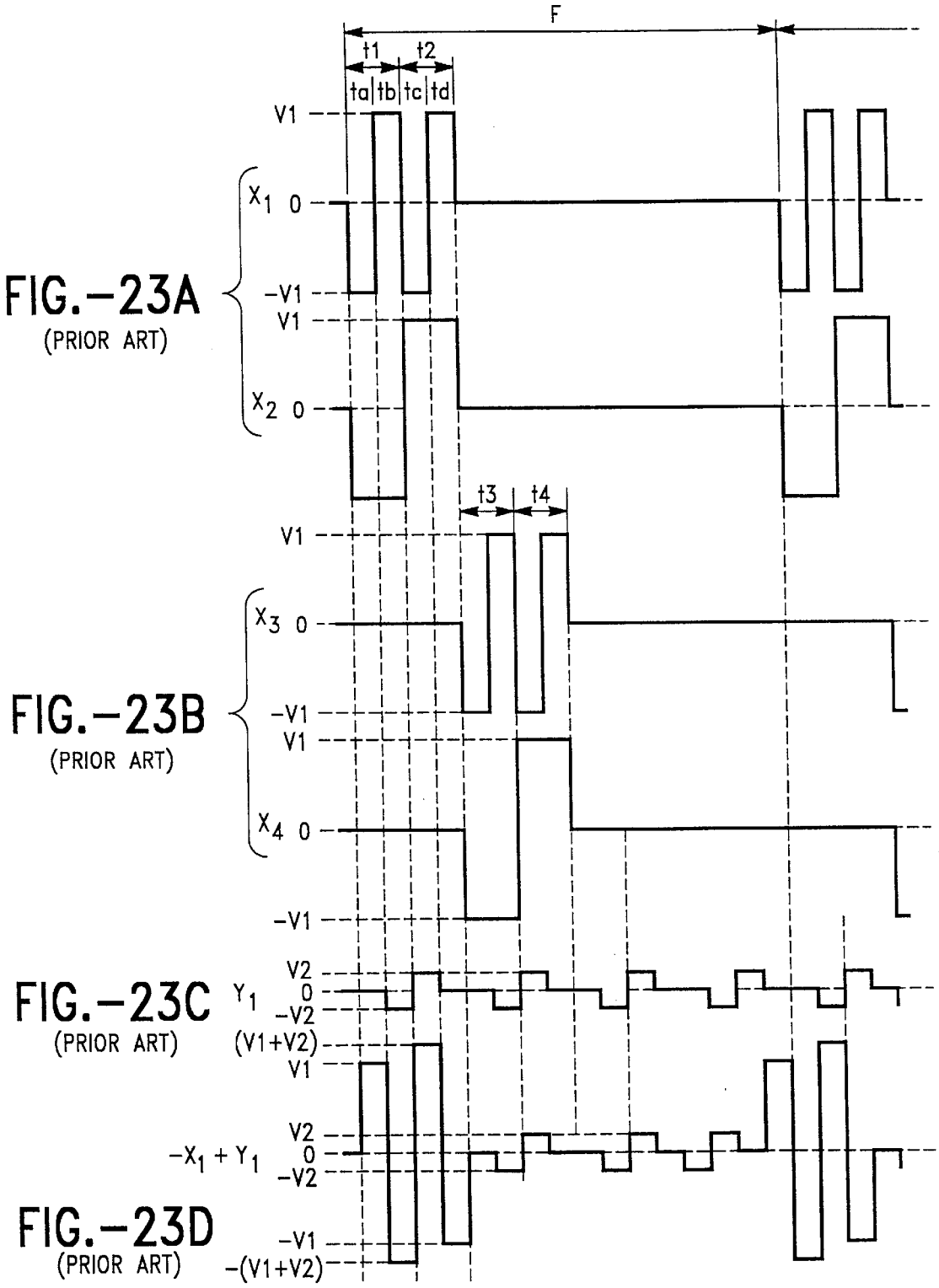
FIG.-23A (PRIOR ART)
FIG.-23B (PRIOR ART)
FIG.-23C (PRIOR ART)
FIG.-23D (PRIOR ART)
FIGS. 23(*a*)–(*d*) show the applied voltage waveforms of a conventional driving method of a liquid crystal display.
Figure 24A:
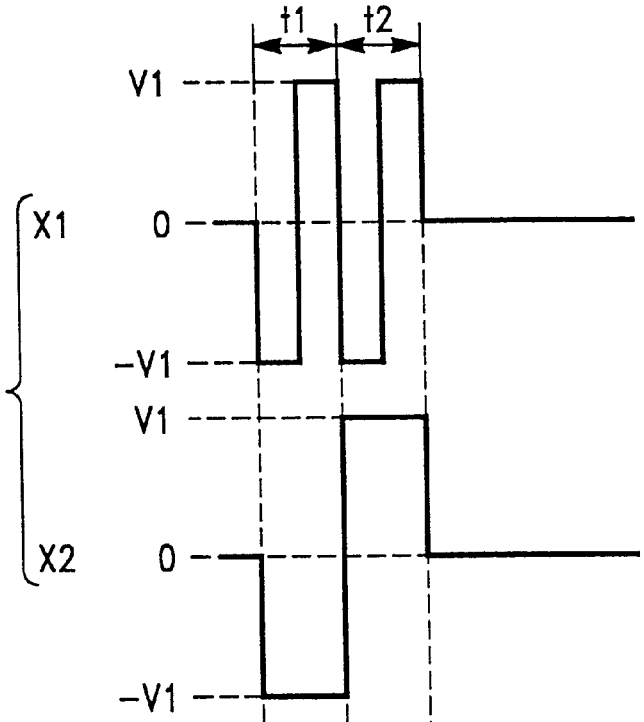
FIG.-24A (PRIOR ART)
FIGS. 24(*a*)–(*b*) illustrates the row selection and column voltage waveforms that are applied to the row and column electrodes in accordance with the conventional driving method of FIGS. 23(*c*)–(*d*).
Figure 24B:
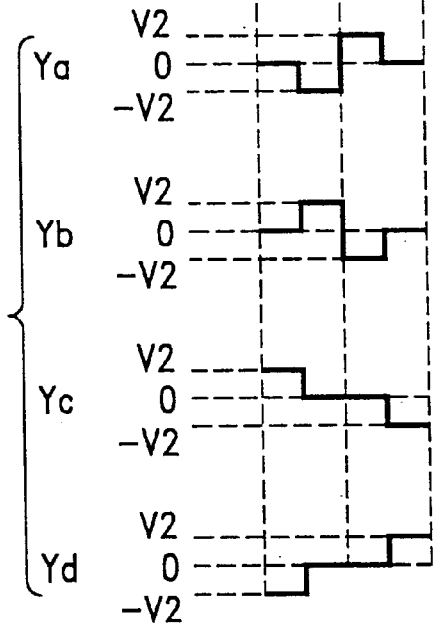
FIG.-24B (PRIOR ART)

Referring to FIGS. 1(*a*)–(*d*), generally speaking, the embodiment of FIGS. 1(*a*)–(*d*) separates the row selection voltage waveforms of FIGS. 23(*a*)–(*c*), for example, into two portions. In the embodiment of FIGS. 1(*a*)–(*d*), the first portion is applied sequentially to each group of the row electrodes and then the second portion is applied sequentially to each group of the row electrodes during one frame period. This is in contrast to the conventional method, such as FIGS. 23(*a*)–(*d*), in which entire row selection signal is applied sequentially to each group of electrodes during one frame period.

More specifically, the first group of row electrode comprising row electrodes $X_1$ and $X_2$ are simultaneously selected in period $t_1$. Row selection voltage waveforms in that time interval similar to those in the conventional method illustrated in FIG. 23(*a*) applied in time interval $t_1$. At the same time, a column voltage waveform selected in accordance with the method described above is applied to each column electrode, $Y_1$ to $Y_m$. In the present embodiment, row electrodes $X_3$ and $X_4$ are then selected with the row selection voltage waveforms shown in FIG. 1(*b*). At the same time column voltage is applied in the same manner to each column electrode, $Y_1$ to $Y_m$. This process is repeated until all of the row electrodes have been selected. This is in contrast to the conventional method of FIGS. 23(*a*)–(*d*) in which voltage waveforms are still applied to row electrodes $X_1$ and $X_2$ during the same interval.

As shown in FIG. 1(*a*), row electrodes $X_1$ and $X_2$ are selected once again in the time duration $t_2$. At the same time, column voltages are applied to each column electrode, $Y_1$ to $Y_m$. The remaining groups of row electrodes are selected with the second portion of the row selection voltage waveforms. All of the row electrodes are selected twice in one frame period F. That is, an image or one screen is displayed when each row electrode is selected twice. Subsequent images are displayed by repeating the aforementioned driving method in subsequent frame periods.

By driving the liquid crystal display panel in this manner, the optical response shown in FIG. 3 is obtained. Referring to FIGS. 28A–D, the optical response of the first embodiment is compared with the optical response of the conventional driving method. It is readily apparent from FIGS. 28A–D, that the optical response of the present invention has a brighter ON state and a darker OFF state than the conventional driving method. Therefore, a liquid crystal display panel driven in accordance with present invention has improved contrast and a reduction of flicker.

As will be appreciated by one of ordinary skill in the art, the row selection period may divided into more than two intervals in one frame period F. In addition, while in the embodiment described above, each group of row electrodes contained two row electrodes, it is contemplated that each group may contain more than two row electrodes. Moreover it is also contemplated that each of the groups of row electrodes may be selected in any arbitrary order.

Second Embodiment

Figures 7A, 7B, 7C, 7D:
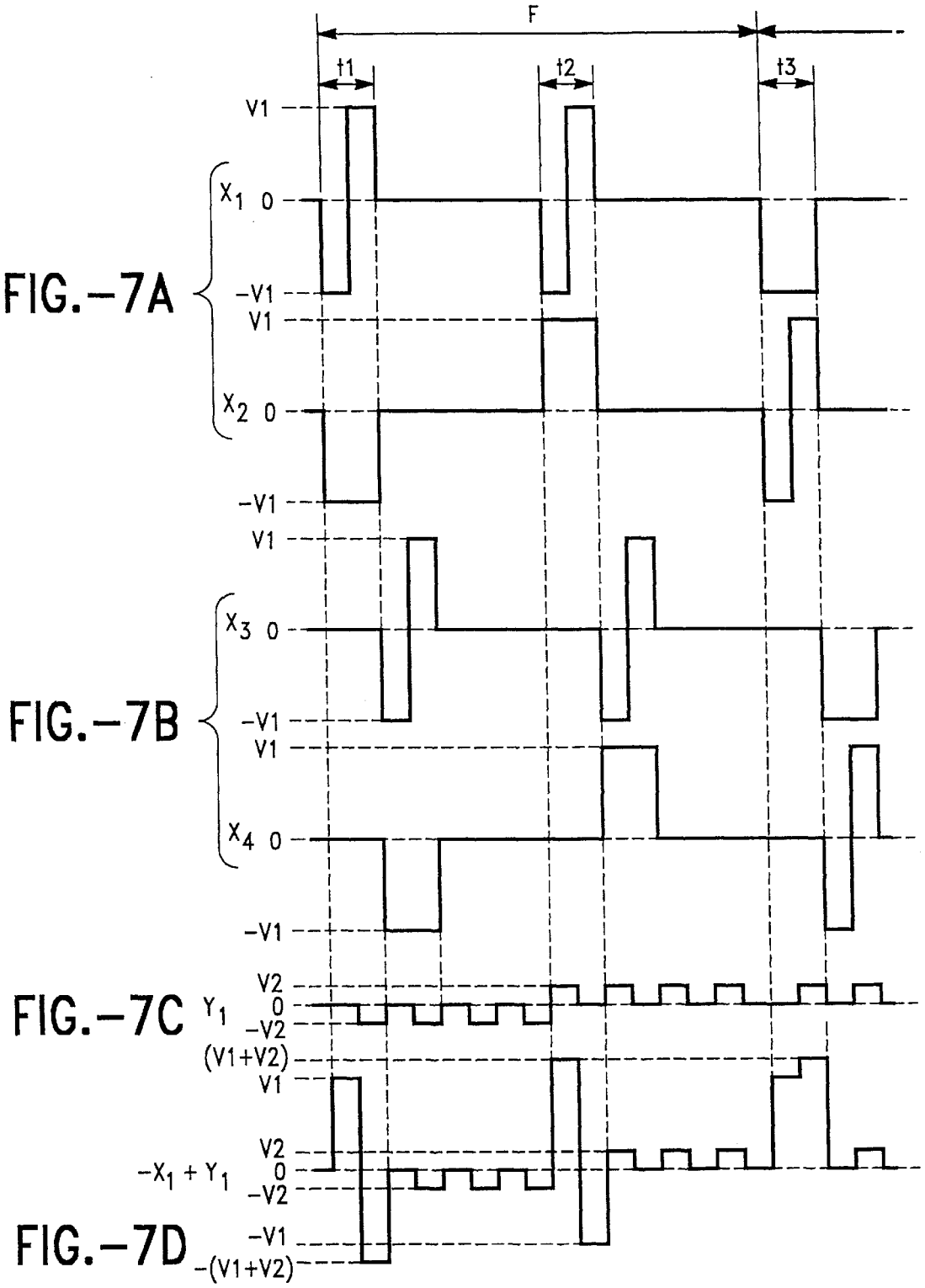
FIGS. 7(*a*)–(*d*) show the applied voltage waveforms of a second embodiment of a driving method of the liquid crystal display according to the present invention.

FIGS. 7(*a*)–(*d*) show a second embodiment of the present invention. In this embodiment, the row selection voltage waveforms applied in the first frame are substantially similar to those of the first embodiment. However, in the second frame, the row selection voltage waveforms applied to the first row electrode in each group in the first frame period is now applied to the second row electrode in each group in the second frame period. Similarly, the row selection voltage waveforms applied to the second row electrode in each group in the first frame is now applied to the first row electrode in each group. In other words, the row selection waveform is alternately applied to each row electrode of each group in alternate frame periods. As noted above, it is contemplated that each group of row electrodes may contain more than two electrodes.

As described above, if for each frame F, if such waveforms are applied, it is possible to prevent pictures on the display from generating non-uniformity caused by differences in the applied voltage waveforms as in conventional methods.

In addition, because in this embodiment the selection period is divided in two intervals within one frame F, just as with the aforesaid first embodiment, the contrast is improved and flickering is also reduced.

Further, in this embodiment, it is also possible to use a drive circuit that is the same as the drive circuit that is explained in the aforesaid embodiment, and to provide with display device having a high display quality as well. In the aforesaid embodiment, the row selection voltage waveforms were replaced after each frame. However, they also can be replaced after a plurality of frames.

The description of the aforesaid first embodiment and second embodiment provided an example in which two row electrodes were selected simultaneously. However, as in the embodiments to be described below, it also is possible to drive by selecting three or more row electrodes simultaneously. In such a case, as in the second embodiment, it is possible to replace in sequence at each one frame or at a plurality of frames the row selection voltage waveforms that are applied to the row electrodes that are selected simultaneously. For example, if each group contained three row electrodes, the row selection waveforms would be selectively applied to the three row electrodes in three frame periods.

Third Embodiment

Figures 8A, 8B, 8C, 8D:
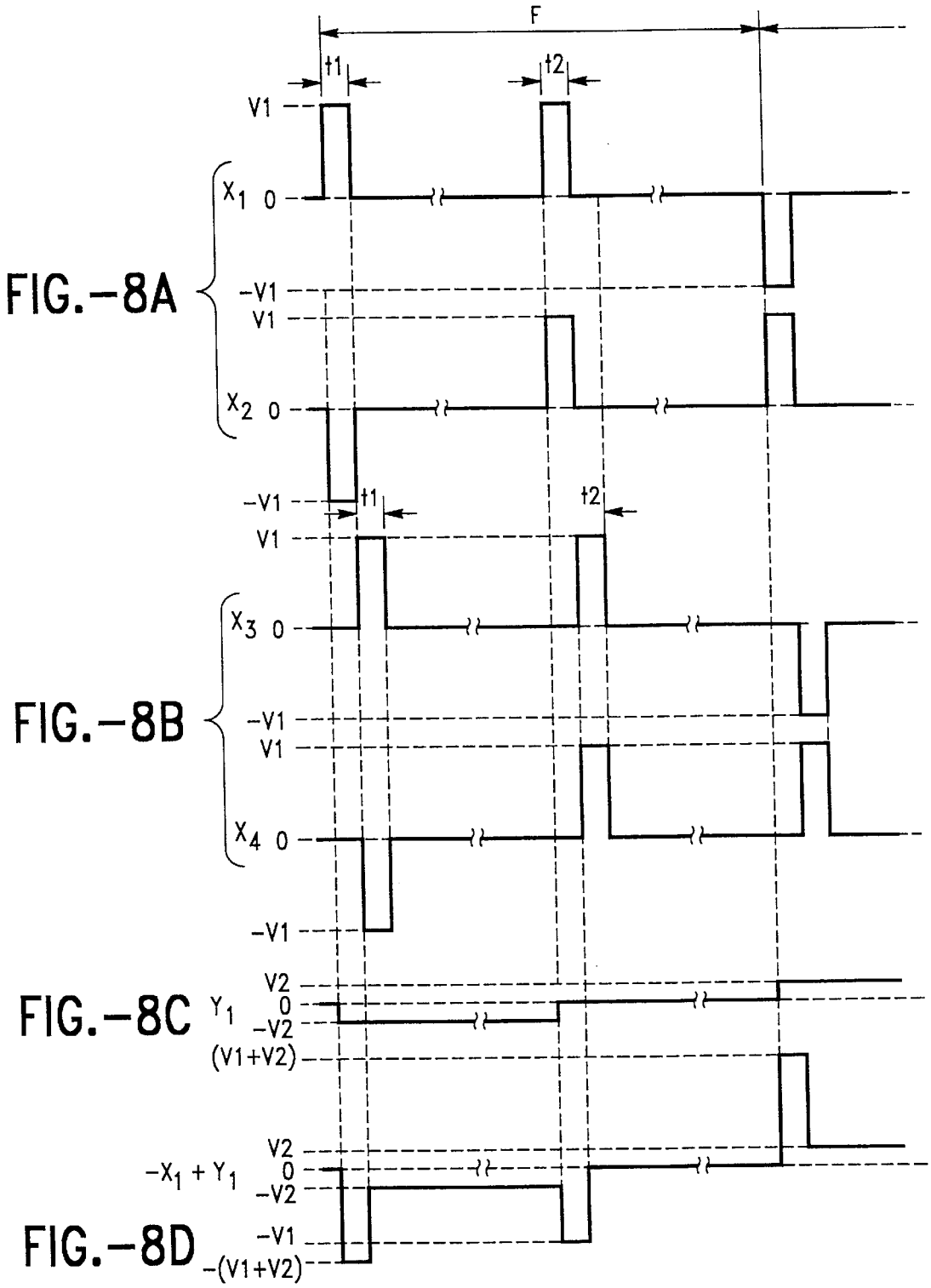
FIGS. 8(*a*)–(*d*) show the applied voltage waveforms of a third embodiment of a driving method of the liquid crystal display according to the present invention.

FIGS. 8(*a*)–(*d*) illustrate a third embodiment of the present invention. As shown therein, the row selection voltage waveforms applied in the first frame are substantially similar to those of the first embodiment. However, in the second frame, the row selection voltage waveforms are inversions of the row selection voltage waveforms applied in the first frame. That is, the row selection voltage waveforms in the second frame period have the opposite polarities to those of the first frame period. In the preferred embodiment, the polarity of the waveforms are inverted for each frame period.

More specifically FIG. 8(*a*) depicts the row selection voltage waveforms applied to row electrodes $X_1$ and $X_2$, FIG. 8(*b*) depicts the row selection voltage waveforms applied to row electrodes $X_3$ and $X_4$, FIG. 8(*c*) illustrates the voltage waveforms applied to column electrode $Y_1$, and FIG. 8(*d*) illustrates the synthesized voltage waveforms applied to the pixels that are formed at the intersection of row electrode $X_1$ and column electrode $Y_1$.

Similar to the aforesaid first embodiment, two row electrodes are selected simultaneously. The row voltage with the voltage waveforms shown in FIG. 8(*a*) are applied to the row electrodes $X_1$ and $X_2$ for simultaneously selection. A display such as that shown in FIG. 2 is provided by dividing the selection period in two intervals or portions within one frame period.

The sequence of the row electrode selection is the same as that in the aforesaid first embodiment. First, row electrodes $X_1$ and $X_2$ are selected and the row selection voltage waveform is applied to these electrodes for a time duration $t_1$. At the same time, the designated column voltage, which corresponds to the display data, is applied to all of the column electrodes $Y_1$ to $Y_m$. Next, row electrodes $X_3$ and $X_4$ are selected and the same row voltage waveforms as the aforesaid row electrodes $X_1$ and $X_2$ are applied there for the time duration $t_{11}$. At the same time, the designated column voltage, which corresponds to the display data pattern, is applied to all of the column electrodes $Y_1$ to $Y_m$. This is repeated until all of the row electrodes $X_1$ to $X_n$ have been selected.

Next, row electrodes $X_1$ and $X_2$ are selected once again and row selection, voltage is applied to them for the time duration $t_2$. At the same time, the designated column voltage, which corresponds to the display data, is applied to all of the column electrodes $Y_1$ to $Y_m$. Next, row electrodes $X_3$ and $X_4$ are selected and the same row voltage waveforms as the aforesaid row electrodes, $X_1$ and $X_2$, are applied thereto for the time duration $t_{12}$. At the same time, the designated column voltage, which corresponds to the display data, is applied to all of the column electrodes $Y_1$ to $Y_m$. This sequence is repeated until all of the row electrodes $X_1$ to $X_n$ have been selected.

In this embodiment, the polarity of the row selection voltage waveforms applied to each row electrode is inverted or reversed at each frame. This is referred to as an alternating current drive scheme. In such a case, it is possible to reverse the positive and negative polarities at alternate frames. In addition, it also is possible to apply the alternating current drive method mentioned above to the previously described embodiments and to the embodiments to be described below.

As should now be apparent, the column voltages are selected in accordance with the method as described above.

FIG. 9 illustrates four types of display patterns of the pixels on, for example, row electrodes $X_1$ and $X_2$. As noted above, row electrodes $X_1$ and $X_2$ are selected simultaneously. As shown in FIG. 9, those pixels having solid circles are in the ON state and those pixels having open circles are in the OFF state. The display pattern on line a indicates that the pixels on row electrodes $X_1$ and $X_2$ are both in the OFF state, the display pattern on line b indicates that the pixel on row electrode X1 is in the OFF state and that the pixel on row electrode $X_2$ is in the ON state, the display pattern on line c indicates that the pixel on row electrode $X_1$ is in the ON state and that the pixel on row electrode $X_2$ is in the OFF state, and the display pattern on line d indicates that the pixels both row electrodes $X_1$ and $X_2$ are in the ON state.

FIGS. 10(*a*)–(*b*) show the relationship between the row selection voltage waveforms applied to the row electrodes that are selected simultaneously and the signal waveforms applied to each column electrode. In FIG. 10(*a*), $X_1$ and $X_2$ represent the row selection voltage waveforms applied to row electrodes $X_1$ and $X_2$ and $Y_a$ to $Y_d$ represent the column voltage waveforms applied to column electrodes $Y_1$ to $Y_m$ in correspondence to display patterns on lines a to d of FIG. 9.

In other words, when the pixels on both row electrodes $X_1$ and $X_2$ are both in the OFF state, as in display pattern a in FIG. 9, the $Y_a$ column voltage waveforms in FIG. 10(*b*) is applied. In the same manner, column voltage waveforms $Y_b$, $Y_c$ and $Y_d$ will be applied to display patterns b, c and d, respectively.

As in previously described in the second example of the conventional method, the column voltage waveform is similarly determined. In the case of the column voltage waveforms described above, if assuming that when the row selection voltage pulse applied to row electrodes $X_1$ and $X_2$ is positive, the pixel is assigned a first value of 1. Alternatively, if the voltage pulse is negative, the pixel is assigned a first value of −1. The pixel is assigned a second value of −1 if it is in the ON state and a second value of 1 if it is in the OFF state. As in the example of the conventional method, the number of mismatches and matches are determined. When the difference between the number of matches and the number of mismatches is 2, $V_2$ volts is applied, when the difference is zero, zero volts is applied, and when the difference is −2, $-V_2$ volts is be applied.

For example, as in display pattern a in FIG. 9, since both pixels formed in row electrodes $X_1$ and $X_2$ are in the OFF state, those pixels each have a second value of 1. When compared to the voltage pulse in time interval $t_1$, those pixels have first values of −1 and 1 respectively. As will now be apparent, the difference between the number of mismatches and matches is zero. Accordingly, column voltage of zero is applied to the column. Similarly, in time period $t_2$ the number of mismatches is zero and the number of matches is two. Accordingly, a voltage of $V_2$ is applied in period $t_2$.

As for the other column voltage waveforms, $Y_b$ to $Y_d$ are applied to obtain the display patterns as shown in lines b, c, and d, respectively, of FIG. 9. Since the method to obtain these waveforms are similar to that of $Y_a$, a further discussion is deemed unnecessary.

Indeed, when 240 row electrodes were fabricated and the driving took place at drive voltages set to $V_1$=16.8 volts and $V_2$=2.1 volts, the same optical response as in the previously described FIG. 3 is obtained. In the ON state, this embodiment has more brightness and in the OFF state the display is darker than in the conventional arrangements.

Moreover, in the drive method of this embodiment, it also was possible to use a drive circuit that is similar as that of the first embodiment, which is shown in the previously described FIG. 4, a row electrode driver that is similar to that of the first embodiment, which is shown in FIG. 5, and a column electrode driver that is similar to that of the first embodiment, which is shown in FIG. 6. In such a case, as in the previously described embodiment, the calculation of the difference between the number of matches and number of mismatches may take place in the arithmetic operation circuit 4.

A converted data signal is transferred to the column electrode driver by arithmetic operation circuit 4, to generate the column voltage waveforms applied to each column electrode.

By using a drive circuit such as that described above, it is possible to execute the previously described drive method simply and reliably. In addition, it also is possible to provide a display device that has excellent display performance.

Fourth Embodiment

Figures 11A, 11B, 11C, 11D:
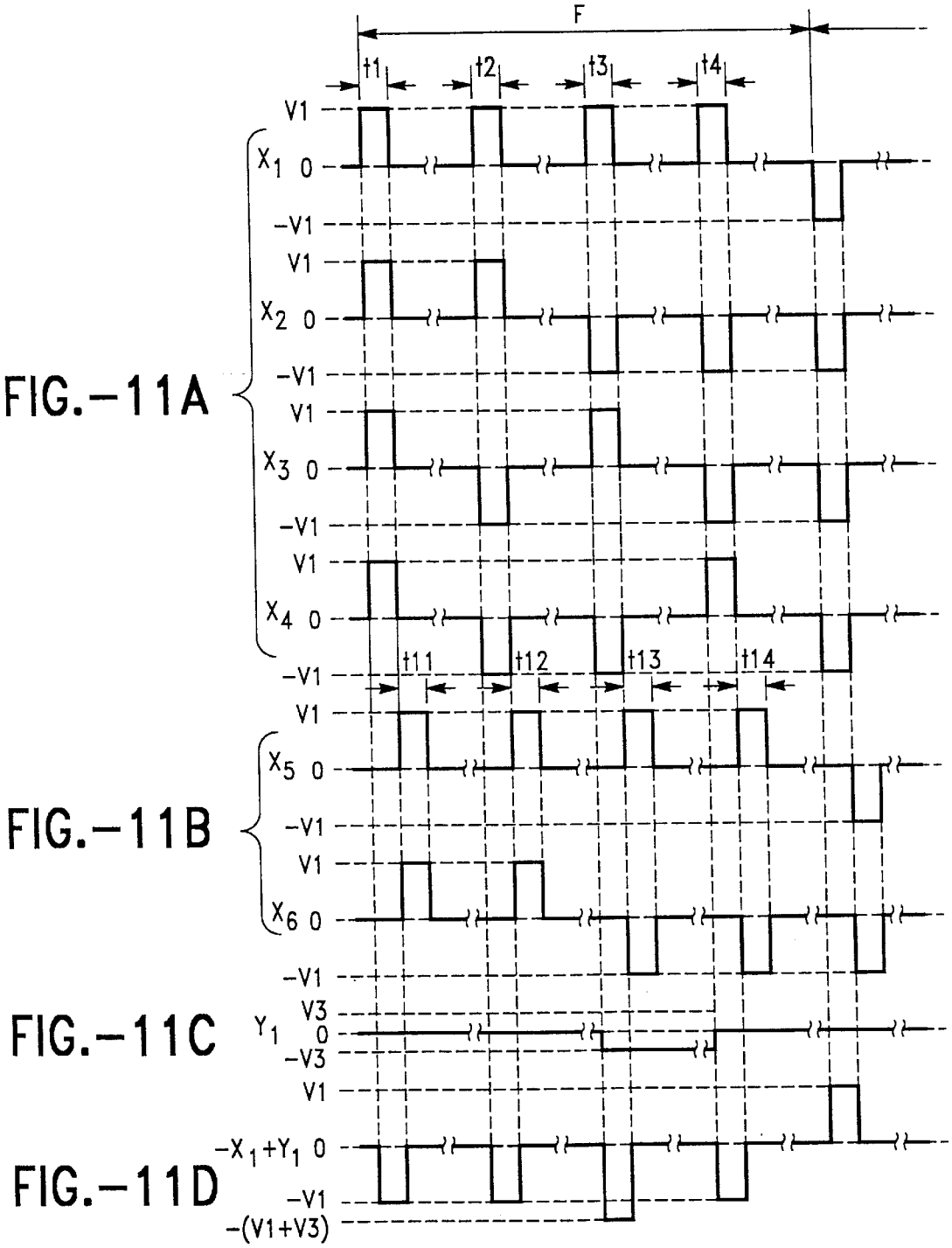
FIGS. 11(*a*)–(*d*) show the applied voltage waveforms of a fourth embodiment of a driving method of the liquid crystal display according to the present invention.

FIGS. 11(*a*)–(*d*) show voltage waveforms applied to the row and column electrodes of a liquid crystal display panel that represent a fourth embodiment of the drive method of the liquid crystal display panel of the present invention. In FIGS. 11(*a*)–(*d*), each group of row electrodes comprises four row electrodes and the row selection signal is applied in the four row electrodes in each group simultaneously. Additionally, the row selection waveform comprises four portions or time intervals within one frame period. In other words, each row electrode is selected four times during one frame period. More specifically, FIG. 11(*a*) illustrates the row selection signal applied to row electrodes $X_1$–$X_4$, FIG. 11(*b*) illustrates the row selection signal applied to the next group of row electrodes. Solely as a matter of clarity, only row electrodes $X_5$ and $X_6$ are shown, FIG. 11(*c*) shows the voltage waveforms that are applied to column electrode $Y_1$, and FIG. 11(*d*) shows the synthesized voltage waveforms applied to the pixel formed at the intersection of row electrode $X_1$ and column electrode $Y_1$.

In the fourth embodiment, row electrodes $X_1$ to $X_4$ are simultaneously selected for the time duration $t_1$. At the same time, a designated column voltage that corresponds to the display data is applied to column electrodes $Y_1$ to $Y_m$. Next, row electrodes $X_5$ to $X_6$ are selected by the application of the same row voltage as that for the previously described row electrodes $X_1$ to $X_4$ in the time duration $t_{11}$. At the same time, the designated column voltage that corresponds to the display data is applied to each column electrode, $Y_1$ to $Y_m$. This is repeated until all of the row electrodes, $X_1$ to $X_n$, have been selected.

Next, row electrodes $X_1$ to $X_4$ are selected once again and row selection voltages are applied to them during the time duration $t_2$. At the same time, the designated column voltage that corresponds to the display data will be applied to each column electrode, $Y_1$ to $Y_m$. After this, row electrodes $X_5$ to $X_6$ are selected and the same row voltage as the previously described row electrodes $X_1$ and $X_2$ is applied to them during the time duration $t_{12}$. At the same time, the designated column voltage that corresponds to the display data is applied to each column electrode, $Y_1$ to $Y_m$. This is repeated until all of the row electrodes, $X_1$ to $X_n$, have been selected. By repeating the same operation as the above operation four times in one frame F, one image or one screen will be displayed.

In this embodiment, the polarity of the row selection waveforms are reversed in the second frame period. Moreover, in this embodiment, the column voltage is determined as discussed above.

FIG. 12 depicts a display pattern according to the present invention, for example FIG. 12 illustrates the pixels formed at the intersections of rows electrodes $X_1$–$X_4$ and column electrodes $Y_a$–$Y_h$. Similar to the previous examples, those pixels having closed circles are in the ON state and those pixels having open circles are in the OFF state.

FIG. 13(*a*) illustrates the row selection voltage waveforms applied to each of the row electrodes, $X_1$ to $X_4$, FIG. 13(*b*) shows the column voltage waveforms applied to column electrodes $Y_a$ to $Y_m$ in accordance with the display patterns a to h in FIG. 12.

That is to say, when the pixels on simultaneously selected row electrodes X1 to X4 are all OFF, such as, for example, display pattern on line a of FIG. 12, the Ya column voltage waveform in FIG. 13(*b*) is applied. Similarly, column voltage waveform Yb is applied to display the pattern on line b voltage waveform Yc is applied to display the pattern on line c, voltage waveform Yd is applied to display the pattern on line d, voltage waveform Ye is applied to display the pattern on line e, voltage waveform Yf is applied to the case of display pattern f, column voltage waveform Yg is applied to display the pattern on line g, and column voltage waveform Yh is applied to display the pattern on line h.

As is apparent to one of ordinary skill in the art, the column voltage waveforms are determined in accordance with the previously described method. Accordingly, the detail of which will be omitted.

As described above, in this embodiment as well, four row electrodes are selected in sequence and driving is carried out by dividing the selection period into four separated intervals within the one frame F.

When fabricating 240 row electrodes and by driving with the drive voltage as $V_1$=12 volts, $V_2$=1.5 volts, and $V_3$=3 volts, the optical response is the same as that shown in previously described FIG. 3. In the ON condition, the pixels are brighter than those of the conventional devices. These allow an improvement in contrast and a reduction in flicker. As will be understood by one of ordinary skill in the art, the driving method of the fourth embodiment may be implement by the circuit diagram of FIGS. 4–6. More specifically, it is contemplated that the calculation of the difference between the number of matches and number of mismatches described above is carried out by arithmetic operation circuit 4. In this arrangement, the second analog switches 25 of the column electrode driver 2 selects the waveform voltage for the column electrodes, Y1 to Ym, from among five voltage levels, $V_3$, $V_2$, 0, $-V_2$ and $-V_3$.

In the third embodiment and the fourth embodiment, driving was accomplished by dividing the selection period either in two or four intervals and separating them two times or four times within one frame F. However, the number of times the selection period is divided may be changed to improve the displayed image. In addition, the number of row electrodes comprising each group may be varied to improve the displayed image.

Fifth Embodiment

Figures 14A, 14B, 14C, 14D:
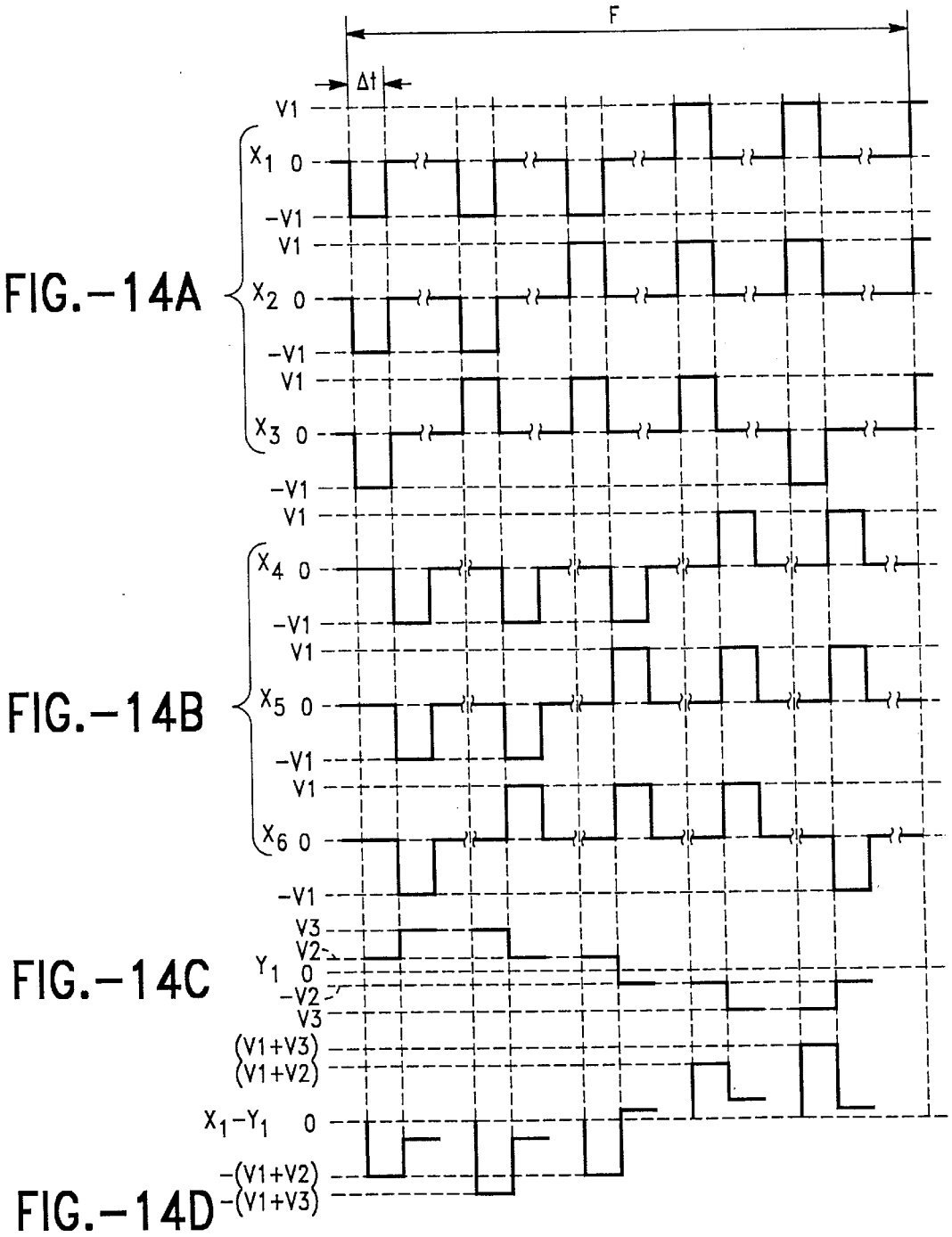
FIGS. 14(*a*)–(*d*) shows the applied voltage waveforms of a fifth embodiment of a driving method of the liquid crystal display of the present invention.

FIGS. 14(*a*)–(*d*) depict a fifth embodiment of the present invention. In the fifth embodiment, the row selection voltage waveforms are based on the row selection voltage waveforms depicted in FIG. 25(*a*). However, in the fifth embodiment, the selection period is divided into eight portions. For a matter of convenience, only the first five portions are illustrated. More particularly, the row electrode voltage waveforms are divided and separated in 8 intervals having equal time periods.

At the same time, the column voltage waveforms of the designated voltage level, correspond to the difference between the number of mismatches and matches, as discussed above.

A liquid crystal display panel driven according to this method, has pixels which are brighter in the ON state and darker in the OFF state. As a result there is an improvement in contrast and reduction in flicker as compared to conventional arrangements.

It is also contemplated, that the driving method may be implemented by the circuits of FIGS. 4–6 described above. As noted above, the number of intervals and the number of row selected simultaneously may be varied to improve the display of the image.

Sixth Embodiment

As stated above, the number of bit-word patterns when selecting and driving a plurality (h number) of row electrodes in sequence is $2^h$. For example, as in the aforesaid example, when h=3, $2^3$=8 patterns. With ON is assigned the value 1 and OFF is assigned the value 0, the voltage ON and OFF pattern shown in FIG. 15(*a*) that applies this waveform to row electrodes, X1, X2 and X3, may be expressed as shown in the Table E below.

TABLE E

| | | | | | | | | |
|---|---|---|---|---|---|---|---|---|
| X1 | 0 | 0 | 0 | 0 | 1 | 1 | 1 | 1 |
| X2 | 0 | 0 | 1 | 1 | 0 | 0 | 1 | 1 |
| X3 | 0 | 1 | 0 | 1 | 0 | 1 | 0 | 1 |

Figures 15A, 15B, 15C:
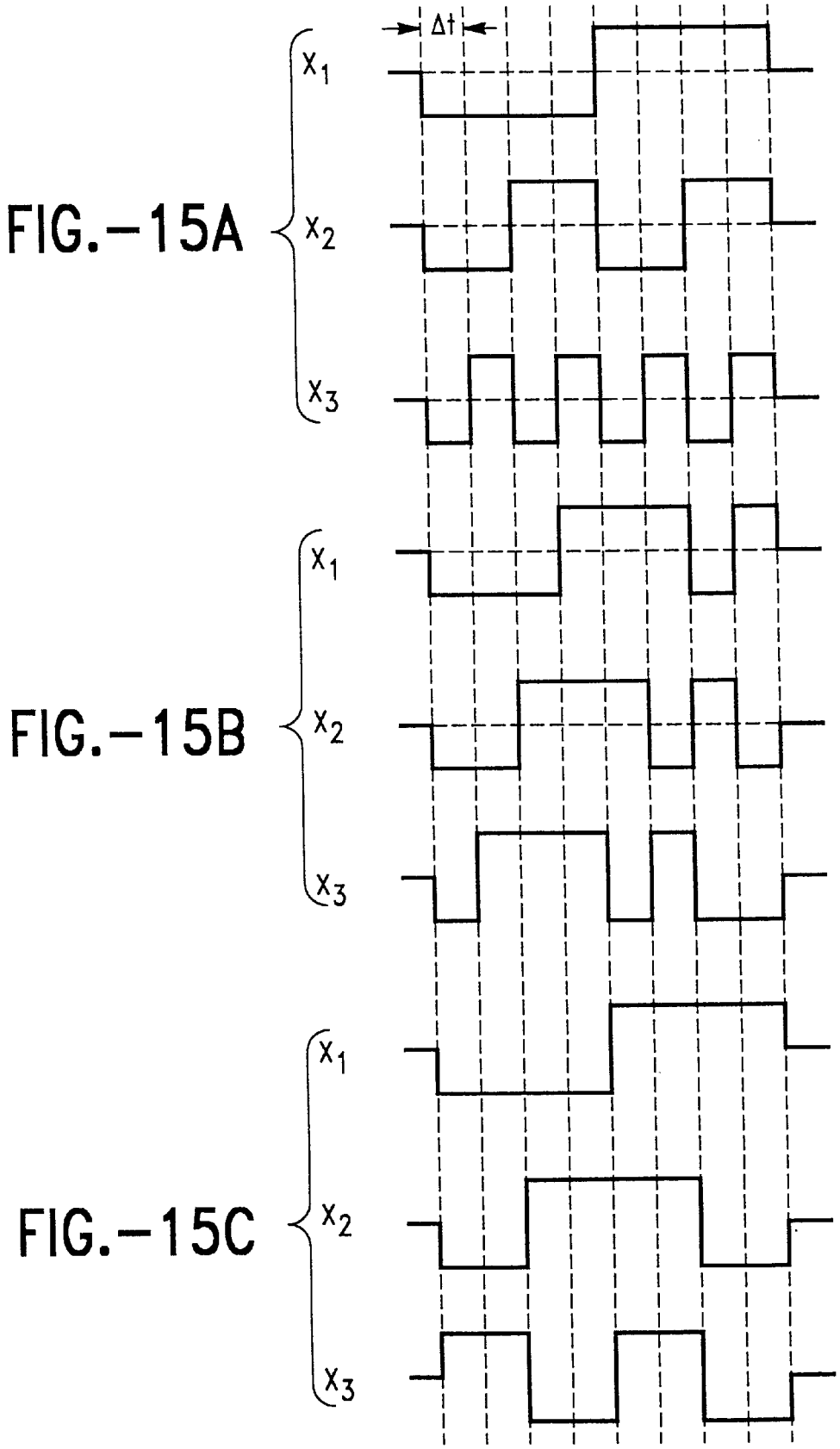
FIGS. 15(*a*)–(*c*) are other examples of the applied electrodes voltage waveforms in accordance with the present invention.

It is noted that waveforms applied in accordance with FIG. 15(*a*) have many different frequency components. More specifically, the frequencies of the waveforms on row electrode X1 are 4·Δt and 4·Δt, the frequencies of the waveforms on row electrode X2 are 2·Δt, 2·Δt, 2·Δt and 2·Δt, and the frequencies of the waveforms on row electrode X3 are Δt, Δt, Δt, Δt, Δt, Δt, Δt, and Δt. Such differences in frequency appear to cause distortion of the displayed image.

For this reason, the voltage waveforms are changed to eliminate the deviation of the frequency components. However, using the type of waveform in FIG. 15(*b*), not only those shown in FIG. 15(*a*) above, when the number of row electrodes that are simultaneously selected increases, the number of above described bit-word patterns will increase exponentially. Additionally, each pulse width is narrower, and there is a potential for rounding or distorting the waveforms. Further, when implementing gray shade display, for example, such as by pulse width modulation techniques, the narrower the pulse width there is more likelihood of generating crosstalk.

For this reason, in this embodiment, the voltage waveforms applied to the row electrodes are set under the following guidelines so that the pulse widths become wider.

For applied voltage waveforms to the row electrodes, these are determined taking the following into consideration:

(1) Each row electrode must be distinguishable.

(2) The frequency component added to each row electrode must not differ significantly.

(3) There must be alternating current characteristics within one frame or within a plurality of frames.

In other words, the applied voltage patterns are to be appropriately selected, taking the conditions mentioned above into consideration, from among the systems of orthogonal functions, such as natural binary, Walsh and Hadamard.

Among these, item number (1) is an necessary-sufficient condition. In particular, in order to satisfy item number (1), it is preferred that the applied voltage waveforms of each row electrode will each have different frequency components. The applied voltage waveforms, which include different frequency components, are:

X1: 4·Δt, 4·Δt

X2: 2·Δt, 4·Δt, 2·Δt

X3: 2·Δt, 2·Δt, 2·Δt, 2·Δt.

The voltage waveforms of FIGS. 15(*a*)–15(*c*) are determined as discussed below utilizing the natural type Hadamard matrix. As is known to one of ordinary skill in the art, the natural type Hadamard matrix is orthogonal. The natural type Hadamard matrices are:

$$H_2 = \begin{vmatrix} + & + \\ + & - \end{vmatrix} \tag{1}$$

$$H_{2n} = \begin{vmatrix} Hn & Hn \\ Hn & -Hn \end{vmatrix} \tag{2}$$

In the case of n=2, the formula (1) is included in formula (2), thus $H_4$ or $H_2$ can be obtained as follows:

$$H_4 = \begin{vmatrix} + & + & + & + \\ + & - & + & - \\ + & + & - & - \\ + & - & - & + \end{vmatrix} \tag{3}$$

Further, in the case of n=4, the formula (2) is included in formula (3), thus $H_{2n}$ or $H_8$ can be obtained as follows:

$$H_8 = \begin{vmatrix} + & + & + & + & + & + & + & + \\ + & - & + & - & + & - & + & - \\ + & + & - & - & + & + & - & - \\ + & - & - & + & + & - & - & + \\ + & + & + & + & - & - & - & - \\ + & - & + & - & - & + & - & + \\ + & + & - & - & - & - & + & + \\ + & - & - & + & - & + & + & - \end{vmatrix} \tag{4}$$

It is noted that in the natural type Hadamard matrix the orthogonal feature is maintained even under the following transformations:

1. exchanging one row with another,
2. exchanging one column with another,
3. inverting all the polarities of one row, and
4. inverting all the polarities of one column.

Additionally, the natural type Hadamard matrix is a square matrix, e.g. the number of row is equal to the number of columns. However if only a few rows are selected, the orthogonal feature is not lost. For example if 3 rows are selected from $H_8$, the matrix remains orthogonal.

In this example, + corresponds to 1 and − corresponds to 0. Either expression is permissible since the Hadamard matrix is binary.

In accordance with the above guidelines, the voltage waveforms depicted in FIGS. 15(*a*)–(*c*) can be obtain by manipulation of the Hadamard matrix The voltage waveforms for FIG. 15(*a*) are obtained by first preferably selecting the second, third and fifth rows of the $H_8$ matrix to form the matrix A as follows:

$$A = \begin{vmatrix} + & - & + & - & + & - & + & - \\ + & + & - & - & + & + & - & - \\ + & + & + & + & - & - & - & - \end{vmatrix}$$

It is noted that row 1 of the $H_8$ matrix was preferably omitted because it is essentially a DC signal, rows 4, 6, 7 and 8 were preferably omitted because each of those waveforms contained a larger number of different frequency component.

The first row of matrix A is replaced with the third row to form matrix A' as follows:

$$A' = \begin{vmatrix} + & + & + & + & - & - & - & - \\ + & + & - & - & + & + & - & - \\ + & - & + & - & + & - & + & - \end{vmatrix}$$

Finally matrix A' is inverted to obtained the row selection waveforms of FIG. 15(*a*)

$$A'^{-1} = \begin{vmatrix} - & - & - & - & + & + & + & + \\ - & - & + & + & - & - & + & + \\ - & + & - & + & - & + & - & + \end{vmatrix}$$

The waveforms depicted in FIG. 15(*b*) are obtained by various column transformations of matrix $A'^{-1}$. More particularly, the third column is transferred to the seventh column, the fourth column is transferred to the third column, the fifth column is transferred to the eighth column, the seventh column is transferred to the fifth column and the eighth is transferred to the fourth column as shown below:

$$\begin{array}{ll} \text{Column} & 1\ 2\ 3\ 4\ 5\ 6\ 7\ 8 \\ A'^{-1} = & \begin{vmatrix} - & - & - & - & + & + & + & + \\ - & - & + & + & - & - & + & + \\ - & + & - & + & - & + & - & + \end{vmatrix} \\ \text{Column} & 1\ 2\ 3\ 4\ 5\ 6\ 7\ 8 \\ B = & \begin{vmatrix} - & - & - & + & + & + & - & + \\ - & - & + & + & + & - & + & - \\ - & + & + & + & - & + & - & - \end{vmatrix} \end{array}$$

The voltage waveforms shown in FIG. 15(*c*) are obtained by selecting the third, fifth and seventh rows of matrix $H_8$ forming matrix C:

$$C = \begin{vmatrix} + & + & - & - & + & + & - & - \\ + & + & + & + & - & - & - & - \\ + & + & - & - & - & - & + & + \end{vmatrix}$$

Next, the first row is replaced with the third row, the second row is replaced with the first row and the third row is replaced with the second row forming matrix C'

$$C' = \begin{vmatrix} + & + & + & + & - & - & - & - \\ + & + & - & - & - & - & + & + \\ + & + & - & - & + & + & - & - \end{vmatrix}$$

Finally, the first and the second rows are inverted forming matrix C" or the row selection waveform shown in FIG. 15(*c*)

$$C'' = \begin{vmatrix} - & - & - & - & + & + & + & + \\ - & - & + & + & + & + & - & - \\ + & + & - & - & + & + & - & - \end{vmatrix}$$

In these waveforms the polarity of adjacent columns is the same, so if such adjacent columns belong to one group, the matrix is the same as obtained by selecting the third, the fourth and the second columns of matrix $H_4$. In other words, the matrix is obtained without row and column transformation. Moreover, the row select waveforms may be obtained by other binary, Hadamard, Walsh, Rademacher and other orthogonal functions. FIGS. 16(*a*)–(*d*) show the applied row selection voltage waveforms in accordance with the waveforms of FIG. 15(*c*) above.

Figures 25A, 25B, 25C, 25D:
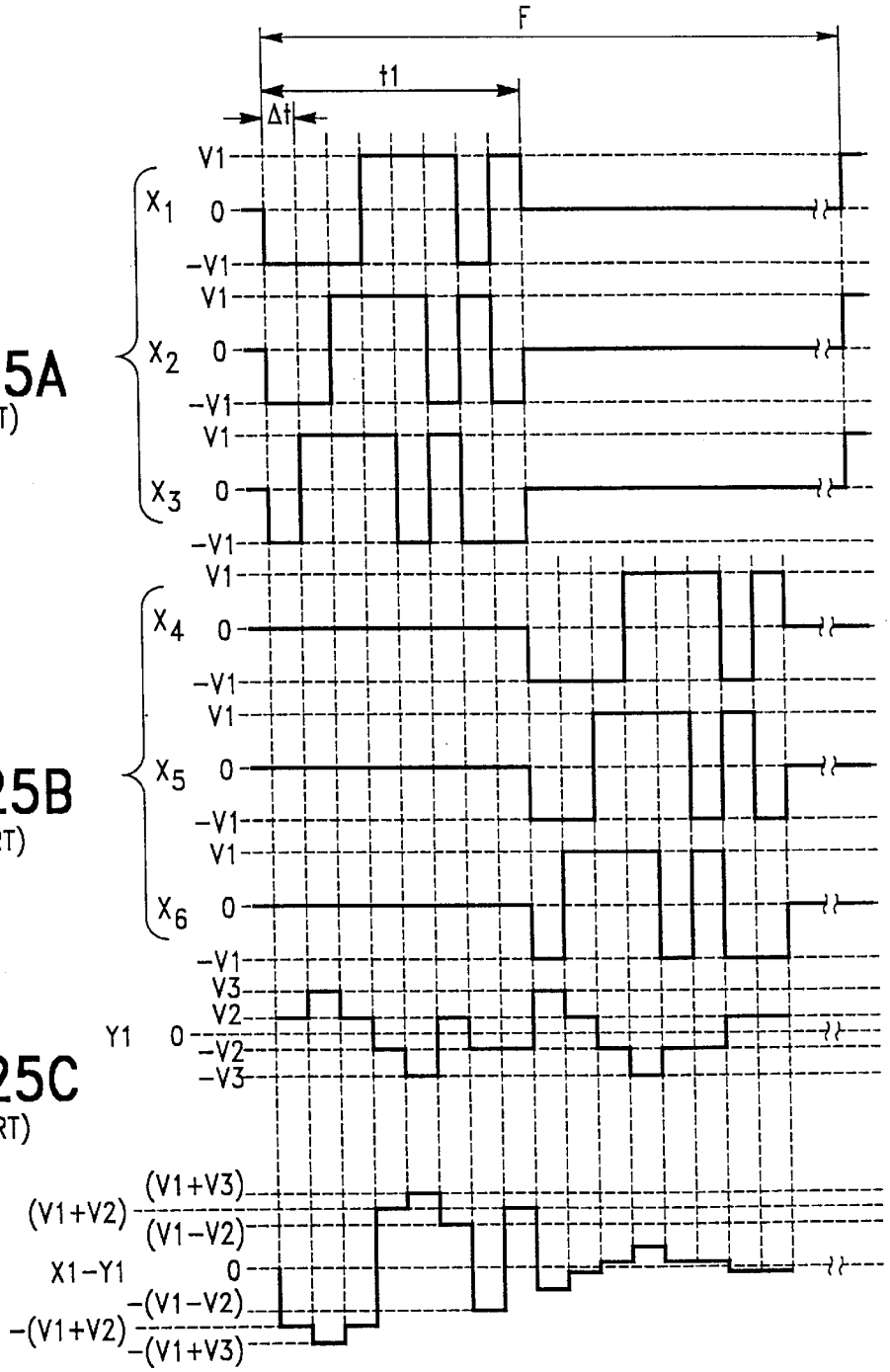
FIG.-25A (PRIOR ART)
FIG.-25B (PRIOR ART)
FIG.-25C (PRIOR ART)
FIG.-25D (PRIOR ART)
FIGS. 25(*a*)–(*d*) show the applied voltage waveforms another conventional driving method of a liquid crystal display.
Figures 28A, 28B, 28C, 28D:
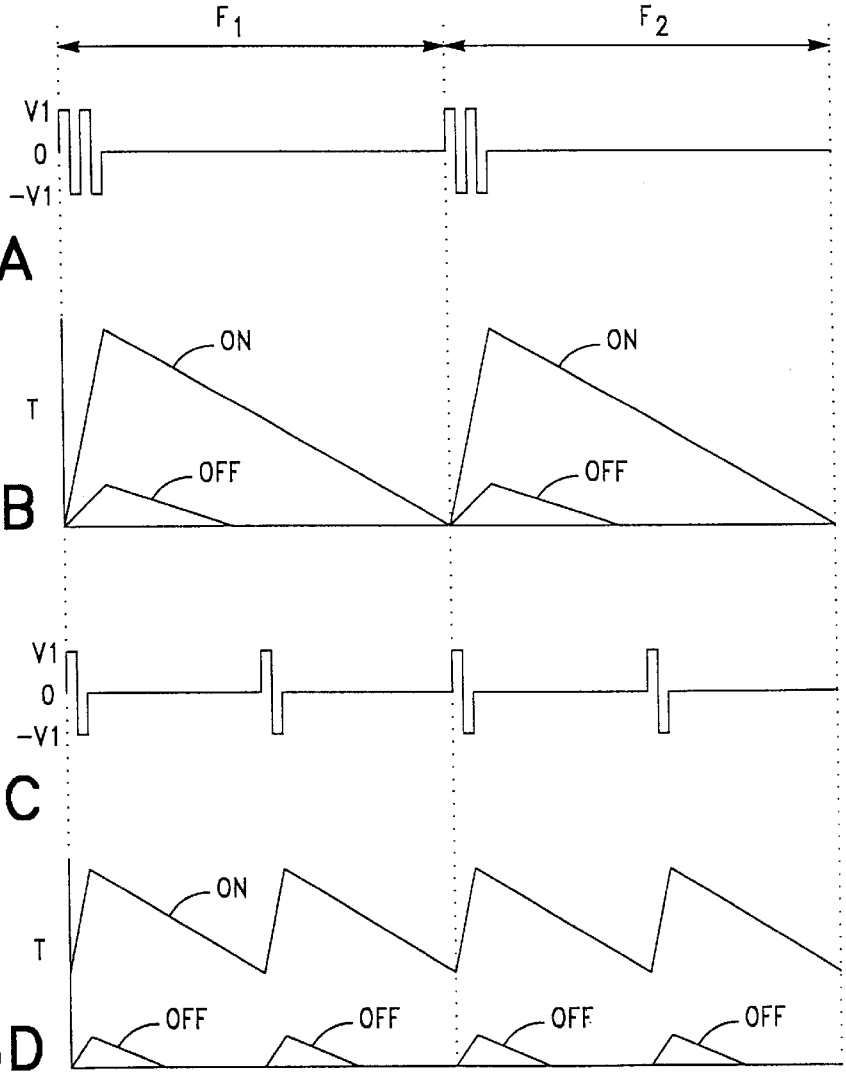
FIG.-28A (PRIOR ART)
FIG.-28B (PRIOR ART)
FIGS. 28(*a*)–(*d*) are graphs comparing the transmissitivity of a liquid crystal panel driven in accordance with the present invention and driven in accordance with a conventional method.

In contrast to the shortest pulse width in FIGS. 15(*a*) and (*b*) above and in contrast to the conventional example in FIG. 25 above, which is Δt, the shortest pulse width of FIG. 15(*c*) and FIG. 16 above is 2Δt, which allows a pulse width to double. By providing the pulse width large in this manner, it is possible to lessen the effect of the waveform rounding, and thus reduce crosstalk. The reduction in crosstalk allows for the selection of a larger number of row electrodes simultaneously.

The waveforms of the embodiment described above are only one example. They can be changed as appropriate to further improve the displayed image. In addition, factors such as the row electrode selection sequence and the arrangement sequence of the pulse patterns that are applied to each row electrode can be changed as desired.

Figures 17A, 17B, 17C, 17D:
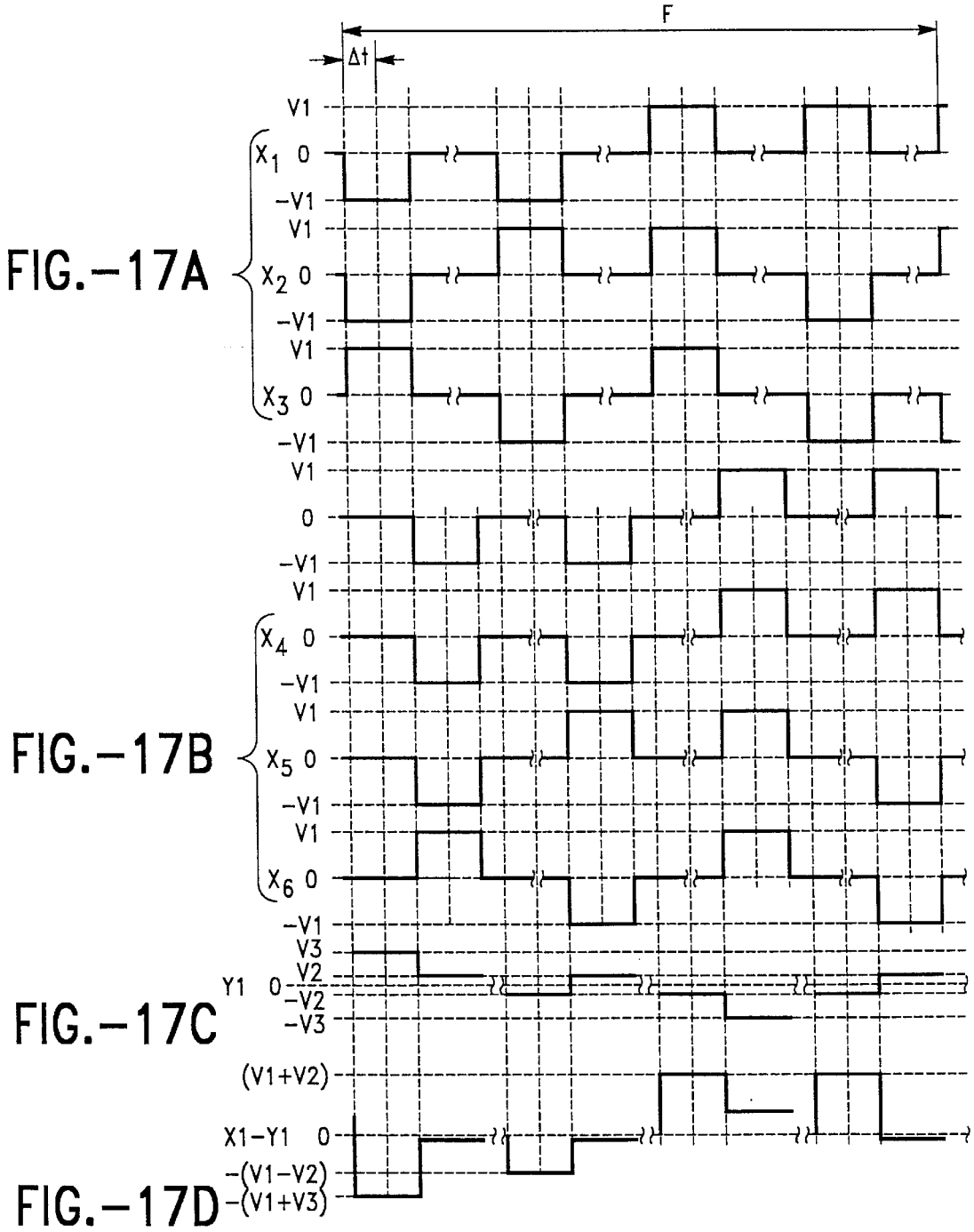
FIGS. 17(*a*)–(*d*) shows the applied voltage waveforms of another embodiment of the FIG. 9 method of the liquid crystal elements according to the present invention.

FIGS. 17(*a*)–(*d*) show an example in which the row selection waveforms in FIG. 16 above are divided into four selection portion within one frame F period and are applied similarly as in the fifth embodiment above.

A liquid crystal display panel driven according to this method, has pixels which are brighter in the ON state and darker in the OFF state. As a result there is an improvement in contrast and reduction in flicker as compared to conventional arrangements. Additionally, crosstalk is reduced.

Seventh Embodiment

In the embodiment described above, four levels, $V_3$, $V_2$, $-V_2$ and $-V_3$, were used as the column electrode voltage levels. However, the number of levels can be reduced under the following method. By reducing the voltage levels, a driving circuit can be fabricated which is simpler and more reliable.

Initially, a description will be given based on the general methods of reducing the number of previously mentioned voltage levels.

In this embodiment, subgroup h comprises a virtual line e. Line e is a virtual electrode and its sole purpose is for determining the voltage levels applied to the column electrodes. There is no requirement that the virtual electrode is to be fabricated on the liquid crystal display panel. However the virtual electrode may be fabricated in a non-display area of the display panel.

The number of voltage levels may be reduced by controlling the number of matches and mismatches of the virtual row electrode data. As a result, the total number of matches and number of mismatches will be limited, and the number of drive voltage levels for column electrodes will be reduced.

With Mi representing the number of mismatches and Vc representing the appropriate constant, $V_{column}$, the applied voltage to the column electrode, is to be as follows:

$$V_{column} = V_c \sum_{j=1}^{h} a_{k*h+j} \oplus d_{k*h+j}$$

$$= V_c(2Mi - h) \quad (V_c\text{: constant})$$

or, more simply:

$V_{column}$=V(i) (0≦i≦h)

In either case, $V_{column}$ is the h+1 level.

For example, the case in which subgroup h=4 and virtual row electrode e=1 will be considered. As in the previous embodiment, the number of levels when h=3 will be four levels, $-V_3$, $-V_2$, $V_2$ and $V_3$. If control takes place through the virtual row electrodes so that there are an even number of mismatches, the results are as shown in the table below. In other words, a virtual pixel formed by the intersection of the virtual row electrode and column electrode has a display state and row selection voltage waveform such that it is either a match or a mismatch.

| Original voltage level | Original number of mismatches | Virtual row electrode | Number of mismatches on revision | Voltage levels on revision |
|---|---|---|---|---|
| $-V_3$ | 0 | Match | 0 | $V_a$ |
| $-V_2$ | 1 | Mismatch | 2 | $V_b$ |
| $V_2$ | 2 | Match | 2 | $V_b$ |
| $V_3$ | 3 | Mismatch | 4 | $V_d$ |

As shown in this example, the virtual pixel is provided with a match when the original number of mismatches is even or zero and the virtual pixel is provided with a mismatch when the original number of mismatches is odd.

As shown above, it is possible to take an original four levels and reduce them to three levels. Of course the mismatches on the virtual electrode may be any combination of matches or mismatches. For example if the virtual pixel were an odd number, the number of mismatches on revision in the above table would change in sequence from the top to 1, 1, 3 and 3. Thus it is possible to reduce the number of voltage levels to two levels.

In another example, a subgroup has h=4 and the number of voltage levels is five, i.e., $-V_3$, $-V_2$, 0, $V_2$ and $V_3$. However, if control takes place through the virtual row electrodes so that there are an even number of mismatches, the results are shown in the table below.

| Original voltage level | Original number of mismatches | Virtual scanning electrode | Number of mismatches on revision | Voltage levels on revision |
|---|---|---|---|---|
| $-V_3$ | 0 | Match | 0 | $V_a$ |
| $-V_2$ | 1 | Mismatch | 2 | $V_b$ |
| 0 | 2 | Match | 2 | $V_b$ |
| $V_2$ | 3 | Mismatch | 4 | $V_d$ |
| $V_3$ | 4 | Match | 4 | $V_d$ |

As shown above, it is possible to take an original five levels and reduce them to three levels. In the above case, it is possible to set the voltage levels so that the number of mismatches is an odd number. As for the virtual row electrodes above, since normally they need not display, they do not necessarily have to be fabricated. However, if they are fabricated, they can be fabricated in an area where they will not effect the display.

Figure 18:
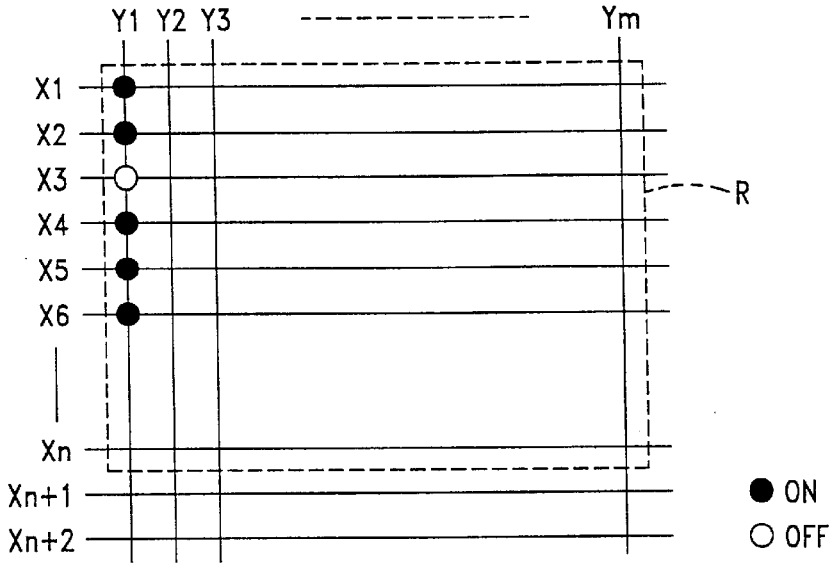
FIG. 18 illustrates a liquid crystal display having virtual electrodes.
Figure 27A:
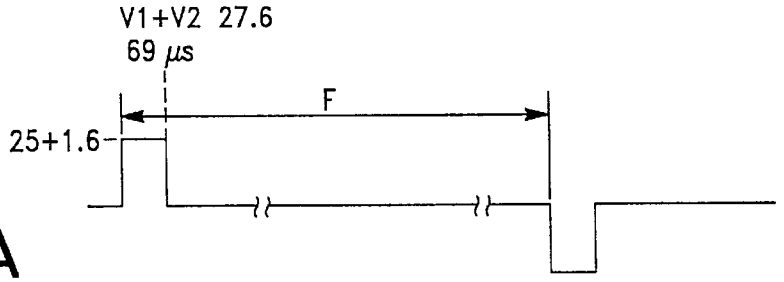
FIG.-27A (PRIOR ART)
FIGS. 27(*a*)–(*c*) are graphs that show the relationship between the applied voltage to a liquid crystal display and the transmissitivity thereof driven in accordance with a conventional driving method.
Figure 27B:
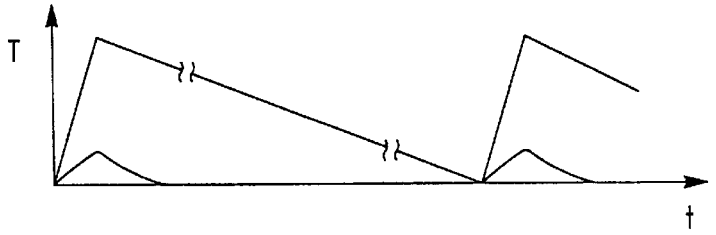
FIG.-27B (PRIOR ART)
Figure 27C:
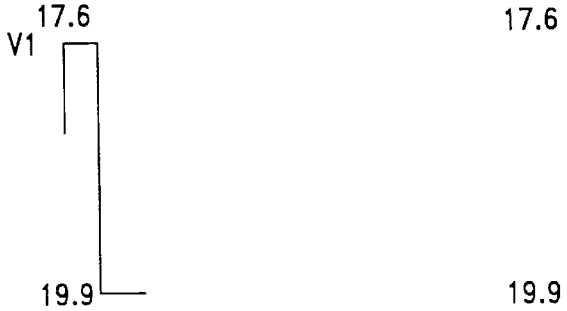
FIG.-27C (PRIOR ART)

For example, as shown in FIG. 18, the virtual row electrodes $X_n$ . . . $X_n$+1 are fabricated on the outside of display region R or non-display area of a liquid crystal display device. If there are extra row electrodes on the outside of display region R, they may be used as virtual row electrodes.

In addition, if e number of virtual row electrodes is increased, the number of voltage levels can be reduced even further. In such a case, if as above, e=1, all of the number of mismatches can be controlled so that they can be divided by 2. For example, in the case of e=2, the number of mismatches all can be controlled so that they can be divided by 3. However, they can all be divided by 3 and have 1 or 2 remaining.

Finally, the maximum number of reductions possible under the above method is 1/(e+1). When e=1, it is ½, except for zero volts.

Figures 19A, 19B, 19C, 19D:
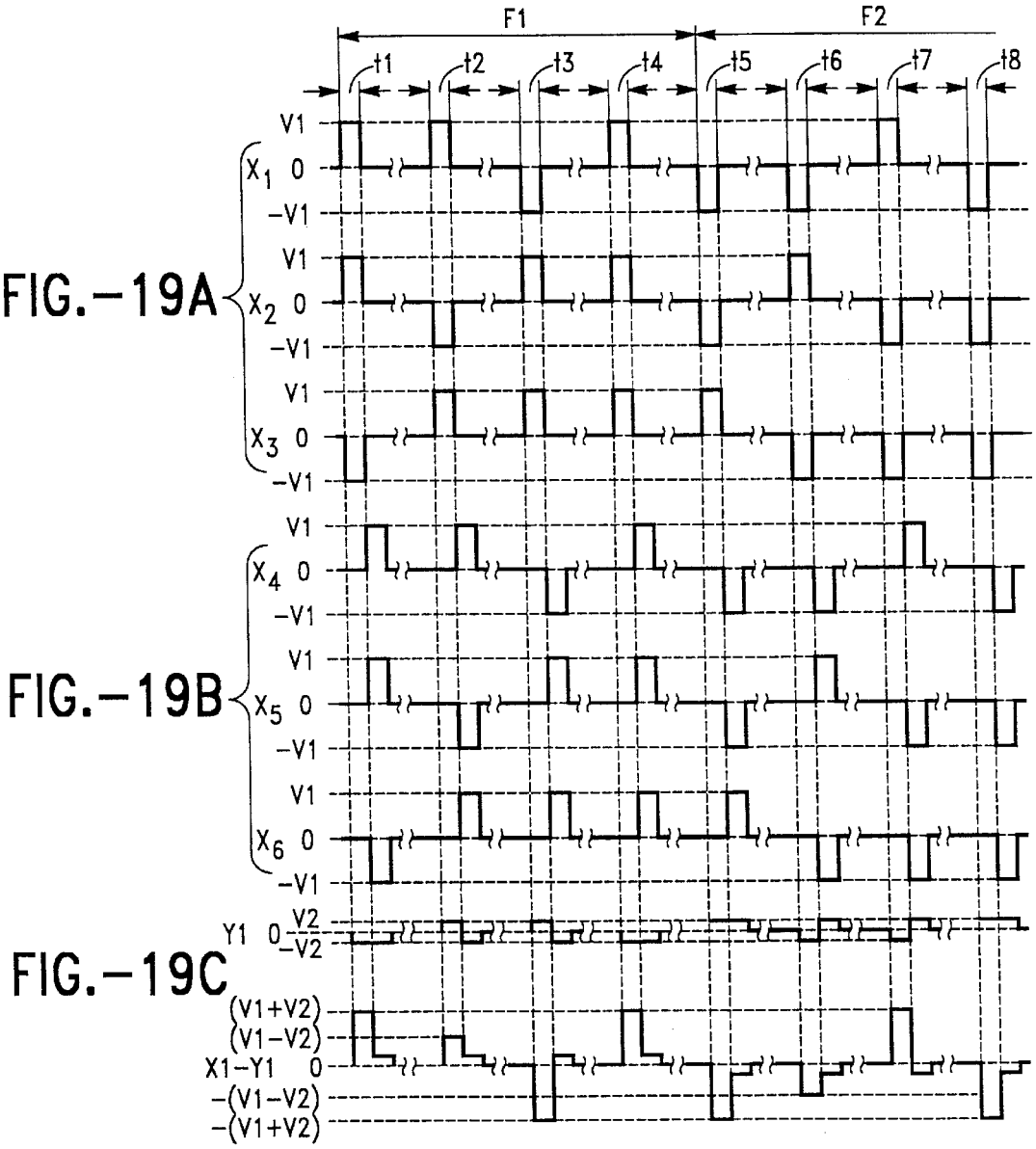
FIGS. 19(*a*)–(*d*) shows the applied voltage waveforms of a seventh embodiment of the driving method of the liquid crystal display of the present invention.

FIGS. 19(*a*)–(*d*) illustrate an example in which three row electrodes and one virtual row electrode are used in sequence to reduce the applied voltage level to the column electrodes. In this example there are four intervals in the frame period. The number of mismatches is determined with the virtual electrode. In this example, the virtual electrode is set to an odd number of mismatches, thus making the number of mismatches a one or a three. In response to this, the voltage level of the column voltage waveform is one of two levels, $V_2$ or $-V_2$.

More specifically, for example in FIG. 18, after the initially selected row electrodes, $X_1$, $X_2$ and $X_3$, as shown in FIG. 20, virtual row electrode Xn+1 is then selected. As noted above the virtual electrodes need not be fabricated. However, if the virtual electrode is fabricated, it is preferable to fabricate the virtual electrode in a non-display region of a liquid crystal display panel, as shown in FIG. 20. The calculation of the column voltages, i.e. determining the number of mismatches, is similar to the column voltage calculation described above. During the time duration t1, assuming ON to be positive voltage being applied to the above row electrodes and OFF to be negative voltage, and assuming that $V_1$, $V_1$ and $-V_1$ volts pulses are applied to each row electrode, $X_1$, $X_2$ and $X_3$, respectively, and assuming that $V_1$ is applied to the virtual row electrode $X_n$+1, and assuming the data that is displayed on the pixels at the crossing point between column electrode $Y_1$ and virtual row electrode Xn+1 at that time to be OFF, the number of mismatches is one. Accordingly, a $-V_2$ voltage pulse is be applied to the column electrode.

Next, looking at the $t_2$ period, assuming that $V_1$ is applied to virtual row electrode Xn+1, the number of mismatches is three, and voltage pulse $V_2$ is to be applied to the column electrode. In addition, assuming that $V_1$ is applied to virtual row electrode Xn+1 in the $t_3$ period, the number of mismatches is three, and a voltage pulse $V_2$ is applied to the column electrode. Finally, assuming voltage pulse $-V_1$ is applied to virtual row electrode $Xn_{+1}$ in the $t_4$ period, there is one mismatch, and a voltage pulse $-V_2$ is applied to the column electrode.

The voltage levels that are applied to the column electrodes can be reduced by assuming the polarity and the display data of the selection pulse to be applied to the virtual row electrodes in this manner, and by making the number of mismatches always odd numbers such as one and three. In the embodiment described above, the voltage levels can be reduced to two levels. However, as stated above, they also may be made into even numbers. By reversing each polarity of the applied voltage in the first frame period $F_1$ and the applied voltage in frame period $F_2$, alternating current drive scheme is realized.

By reducing the number of voltage levels that are applied to the column electrodes as described above, the circuit configuration of the liquid crystal drive can be simplified, allowing a drive circuit that is almost identical to that described in the previous embodiments to be used. In addition, as in the previously described embodiments, this allows a display device with excellent display performance to be obtained.

It should accordingly be understood that the preferred embodiments and specific examples of modifications thereto which have been described are for illustrative purposes only and are not intended to be construed as limitations on the scope of the present invention. Thus, while there have been shown and described and pointed out fundamental novel features of the invention as applied to preferred embodiments thereof, it will be further understood that various omissions and substitutions and changes in the form and details of the devices illustrated and described, and in their operation, may be made by those skilled in the art without departing from the spirit of the invention. It is the intention, therefore, to be limited only as indicated by the scope of the claims appended hereto.

What is claimed is:

1. A drive method for a liquid crystal device comprising the steps of:

(a) applying a scanning signal to each of a plurality of scanning electrodes comprising a selection signal during a selection period and a non-selection signal during a non-selection period; and (b) applying a data signal to each of a plurality of signal electrodes based on display data to be displayed by the liquid crystal device;

wherein step (a) further comprises the steps of:

(1) grouping the plurality of scanning electrodes into p groups, each group comprising at least i scanning electrodes, wherein p and i are integers of at least two;

(2) applying the selection signal substantially simultaneously to the at least i scanning electrodes in one of the p groups and applying the non-selection signal substantially simultaneously to the at least i scanning electrodes in the one of the p groups immediately after applying the selection signal thereto and selecting a level of the selection signal based on an orthogonal function, wherein the orthogonal function has information for determining a level of the selection signal, and wherein step (b) further comprises the step of:

(1) determining the level of the data signal based on a relation between the display data and the level of the selection signal.

2. The drive method according to claim 1, wherein the selection signal applied substantially simultaneously to the at least i scanning electrodes in the one of the p groups changes every predetermined period.

3. The drive method according to claim 2, wherein said predetermined period is a frame period.

4. A drive circuit for a display device having a plurality of scanning electrodes to which a selection signal and a non-selection signal are applied and a plurality of signal electrodes to which a data signal is applied, said drive circuit comprising:

scanning electrode drive means for (1) grouping the plurality of scanning electrodes into p groups, wherein each of the p groups comprises at least i scanning electrodes, wherein p and i are integers of at least two, (2) sequentially selecting each of the p groups and applying the selection signal substantially simultaneously to the at least i scanning electrodes in the selected one of the p groups;

(3) sequentially applying the non-selection signal, immediately after applying the selection signal, substantially simultaneously to the at least i scanning electrodes in the selected one of the p groups per frame; and scanning data generation means for generating data representing a level of the selection signal based on an orthogonal function;

wherein said scanning electrode drive means applies the level of the selection signal to the plurality of scanning electrodes in accordance with the data generated by said scanning data generation means;

memory means for storing display data;

arithmetic means for determining a data signal based on the data generated by said scanning data generation means and the display data stored in said memory means; and signal electrode drive means for applying a level of the data signal to the plurality of signal electrodes in accordance with said arithmetic means.

5. The drive circuit according to claim 4, wherein the selection signal applied substantially simultaneously to the at least i scanning electrodes in the selected one of the p groups changes every predetermined period.

6. The drive circuit according to claim 5, wherein said predetermined period is a frame period.

7. A drive circuit for a display device having a plurality of scanning electrodes to which a selection signal and a non-selection signal are applied and a plurality of signal electrodes to which a data signal is applied, said drive circuit comprising:

a scanning electrode driver to (1) group the plurality of scanning electrodes into p groups, wherein each of the p groups comprises at least i scanning electrodes, wherein p and i are integers of at least two, (2) sequentially select each of the p groups and apply the selection signal substantially simultaneously to the at least i scanning electrodes in the selected one of the p groups;

(3) sequentially apply the non-selection signal, immediately after applying the selection signal, substantially simultaneously to the at least i scanning electrodes in the selected one of the p groups per frame, and a scanning data generator to generate data representing a level of the selection signal based on an orthogonal function;

wherein said scanning electrode driver applies the level of the selection signal to the plurality of scanning electrodes in accordance with the data generated by said scanning data generator;

a memory to store display data;

an arithmetic operations unit to determine a data signal based on the data generated by said scanning data generator and the display data stored in said memory; and a signal electrode driver to apply a level of the data signal to the plurality of signal electrodes in accordance with said arithmetic operations unit.

8. The drive circuit according to claim 7, wherein the selection signal applied substantially simultaneously to the at least i scanning electrodes in the selected one of the p groups changes every predetermined period.

9. The drive circuit according to claim 8, wherein said predetermined period is a frame period.

10. A drive circuit for a display device having a plurality of scanning electrodes to which a selection signal and a non-selection signal are applied and a plurality of signal electrodes to which a data signal is applied, said drive circuit comprising:

scanning electrode drive means for (1) grouping the plurality of scanning electrodes into p groups, wherein each of the p groups comprises at least i scanning electrodes, wherein p and i are integers of at least two, (2) sequentially selecting each of the p groups and applying the selection signal substantially simultaneously to the at least i scanning electrodes in the selected one of the p groups per frame;

(3) sequentially applying the non-selection signal, immediately after applying the selection signal, substantially simultaneously to the at least i scanning electrodes in the selected one of the p groups per frame;

scanning data generation means for generating data representing a level of the selection signal based on an orthogonal function, wherein said scanning electrode drive means applies the level of the selection signal to the plurality of scanning electrodes in accordance with the data generated by said scanning data generation means.

11. The drive circuit according to claim 10, wherein the selection signal applied substantially simultaneously to the at least i scanning electrodes in the selected one of the p groups changes every predetermined period.

12. The drive circuit according to claim 11, wherein said predetermined period is a frame period.

13. A drive circuit for a display device having a plurality of scanning electrodes to which a selection signal and a non-selection signal are applied and a plurality of signal electrodes to which a data signal is applied, said drive circuit comprising:

a scanning electrode driver to (1) group the plurality of scanning electrodes into p groups, wherein each of the p groups comprises at least i scanning electrodes, wherein p and i are integers of at least two, (2) sequentially select each of the p groups and apply the selection signal substantially simultaneously to the at least i scanning electrodes in the selected one of the p groups per frame;

(3) sequentially apply the non-selection signal, immediately after applying the selection signal, substantially simultaneously to the at least i scanning electrodes in the selected one of the p groups per frame;

a scanning data generator for generating data representing a level of the selection signal based on an orthogonal function, wherein said scanning electrode driver applies the level of the selection signal to the plurality of scanning electrodes in accordance with the data generated by said scanning data generator.

14. The drive circuit according to claim 13, wherein the selection signal applied substantially simultaneously to the at least i scanning electrodes in the selected one of the p groups changes every predetermined period.

15. The drive circuit according to claim 14, wherein said predetermined period is a frame period.

16. A drive circuit for a display device having a plurality of scanning electrodes to which a selection signal and a non-selection signal are applied and a plurality of signal electrodes to which a data signal is applied, said drive circuit comprising:

scanning electrode drive means for (1) grouping the plurality of scanning electrodes into p groups, wherein each of the p groups comprises at least i scanning electrodes, wherein p and i are integers of at least two, (2) sequentially selecting each of the p groups and applying the selection signal substantially simultaneously to the at least i scanning electrodes in the selected one of the p groups per frame;

(3) sequentially applying the non-selection signal, immediately after applying the selection signal, substantially simultaneously to the at least i scanning electrodes in the selected one of the p groups per frame;

wherein said scanning electrode drive means applies a level of the selection signal based on an orthogonal function.

17. The drive circuit according to claim 16, wherein the selection signal applied substantially simultaneously to the at least i scanning electrodes in the selected one of the p groups changes every predetermined period.

18. The drive circuit according to claim 17, wherein said predetermined period is a frame period.

19. A drive circuit for a display device having a plurality of scanning electrodes to which a selection signal and a non-selection signal are applied and a plurality of signal electrodes to which a data signal is applied, said drive circuit comprising:

a scanning electrode driver to (1) group the plurality of scanning electrodes into p groups, wherein each of the p groups comprises at least i scanning electrodes, wherein p and i are integers of at least two, (2) sequentially select each of the p groups and apply the selection signal substantially simultaneously to the at least i scanning electrodes in the selected one of the p groups per frame;

(3) sequentially apply the non-selection signal, immediately after applying the selection signal, substantially simultaneously to the at least i scanning electrodes in the selected one of the p groups per frame;

wherein said scanning electrode driver applies a level of the selection signal based on an orthogonal function.

20. The drive circuit according to claim 19, wherein the selection signal applied substantially simultaneously to the at least i scanning electrodes in the selected one of the p groups changes every predetermined period.

21. The drive circuit according to claim 20, wherein said predetermined period is a frame period.

22. A liquid crystal display apparatus comprising:

a liquid crystal matrix panel having a plurality of scanning electrodes to which a selection signal and a non-selection signal are applied and a plurality of signal electrodes to which a data signal is applied; and a driving circuit comprising:

scanning electrode drive means for (1) grouping the plurality of scanning electrodes into p groups, wherein each of the p groups comprises at least i scanning electrodes, wherein p and i are integers of at least two, (2) sequentially selecting each of the p groups and applying the selection signal substantially simultaneously to the at least i scanning electrodes in the selected one of the p groups per frame;

(3) sequentially applying the non-selection signal, immediately after applying the selection signal, substantially simultaneously to the at least i scanning electrodes in the selected one of the p groups per frame;

scanning data generation means for generating data representing a level of the selection signal based on an orthogonal function, wherein said scanning electrode drive means applies the level of the selection signal to the plurality of scanning electrodes in accordance with the data generated by said scanning data generation means;

memory means for storing display data;

arithmetic means for determining a data signal based on the data generated by said scanning data generation means and the display data stored in said memory means; and signal electrode drive means for applying a level of the data signal to the plurality of signal electrodes in accordance with said arithmetic means.

23. The drive circuit according to claim 22, wherein the selection signal applied substantially simultaneously to the at least i scanning electrodes in the selected one of the p groups changes every predetermined period.

24. The drive circuit according to claim 23, wherein said predetermined period is a frame period.

25. A liquid crystal display apparatus comprising:

a liquid crystal matrix panel having a plurality of scanning electrodes to which a selection signal and a non-selection signal are applied and a plurality of signal electrodes to which a data signal is applied; and a driving circuit comprising:

a scanning electrode driver to (1) group the plurality of scanning electrodes into p groups, wherein each of the p groups comprises at least i scanning electrodes, wherein p and i are integers of at least two, (2) sequentially select each of the p groups and apply the selection signal substantially simultaneously to the at least i scanning electrodes in the selected one of the p groups per frame;

(3) sequentially apply the non-selection signal, immediately after applying the selection signal, substantially simultaneously to the at least i scanning electrodes in the selected one of the p groups per frame;

a scanning data generator to generate data representing a level of the selection signal based on an orthogonal function, wherein said scanning electrode driver applies the level of the selection signal to the plurality of scanning electrodes in accordance with the data generated by said scanning data generator;

a memory to store display data;

an arithmetic operations unit to determine a data signal based on the data generated by said scanning data generator and the display data stored in said memory; and a signal electrode driver to apply a level of the data signal to the plurality of signal electrodes in accordance with said arithmetic operations unit.

26. The drive circuit according to claim 25, wherein the selection signal applied substantially simultaneously to the at least i scanning electrodes in the selected one of the p groups changes every predetermined period.

27. The drive circuit according to claim 26, wherein said predetermined period is a frame period.

28. A display apparatus comprising:

a display having a plurality of scanning electrodes and signal electrodes; and a drive circuit comprising:

scanning electrode drive means for (1) grouping the plurality of scanning electrodes into p groups, wherein each of the p groups comprises at least i scanning electrodes, wherein p and i are integers of at least two, (2) sequentially selecting each of the p groups and applying a selection signal substantially simultaneously to the at least i scanning electrodes in the selected one of the p groups per frame;

(3) sequentially applying a non-selection signal, immediately after applying the selection signal, substantially simultaneously to the at least i scanning electrodes in the selected one of the p groups per frame;

scanning data generation means for generating data representing a level of the selection signal based on an orthogonal function, wherein said scanning electrode drive means applies the level of the selection signal to the plurality of scanning electrodes in accordance with the data generated by said scanning data generation means;

memory means for storing display data;

arithmetic means for determining a data signal based on the data generated by said scanning data generation means and the display data stored in said memory means; and signal electrode drive means for applying a level of the data signal to the plurality of signal electrodes in accordance with said arithmetic means.

29. The drive circuit according to claim 28, wherein the selection signal applied substantially simultaneously to the at least i scanning electrodes in the selected one of the p groups changes every predetermined period.

30. The drive circuit according to claim 29, wherein said predetermined period is a frame period.

31. A display apparatus comprising:

a display having a plurality of scanning electrodes and signal electrodes; and a drive circuit comprising:

a scanning electrode driver to (1) group the plurality of scanning electrodes into p groups, wherein each of the p groups comprises at least i scanning electrodes, wherein p and i are integers of at least two, (2) sequentially select each of the p groups and apply a selection signal substantially simultaneously to the at least i scanning electrodes in the selected one of the p groups per frame;

(3) sequentially apply a non-selection signal, immediately after applying the selection signal, substantially simultaneously to the at least i scanning electrodes in the selected one of the p groups per frame;

a scanning data generator to generate data representing a level of the selection signal based on an orthogonal function, wherein said scanning electrode driver applies the level of the selection signal to the plurality of scanning electrodes in accordance with the data generated by said scanning data generator;

a memory to storing display data;

an arithmetic operations unit to determine a data signal based on the data generated by said scanning data generator and the display data stored in said memory; and a signal electrode driver to apply a level of the data signal to the plurality of signal electrodes in accordance with said arithmetic operations unit.

32. The drive circuit according to claim 31, wherein the selection signal applied substantially simultaneously to the at least i scanning electrodes in the selected one of the p groups changes every predetermined period.

33. The drive circuit according to claim 32, wherein said predetermined period is a frame period.

* * * * *

UNITED STATES PATENT AND TRADEMARK OFFICE

CERTIFICATE OF CORRECTION

PATENT NO. : 6,252,573 B1
DATED : June 26, 2001
INVENTOR(S) : Akihiko Ito et al.

It is certified that error appears in the above-identified patent and that said Letters Patent is hereby corrected as shown below:

Column 31,
Lines 33 and 37, change “drive” to -- driving --.

Column 32,
Lines 9 and 13, change “drive” to -- driving --.

Signed and Sealed this

Eleventh Day of March, 2003

JAMES E. ROGAN
*Director of the United States Patent and Trademark Office*